US012145039B2

(12) United States Patent
Cucchiara et al.

(10) Patent No.: US 12,145,039 B2
(45) Date of Patent: Nov. 19, 2024

(54) FOOTBALL GOALPOST ROTATION APPARATUS AND METHOD

(71) Applicant: ABT, Inc., Troutman, NC (US)

(72) Inventors: Christopher Charles Cucchiara, Statesville, NC (US); Timothy Harold Wallace, Charlotte, NC (US)

(73) Assignee: ABT, Inc., Troutman, NC (US)

( * ) Notice: Subject to any disclaimer, the term of this patent is extended or adjusted under 35 U.S.C. 154(b) by 0 days.

(21) Appl. No.: 17/465,831

(22) Filed: Sep. 2, 2021

(65) Prior Publication Data

US 2022/0096907 A1 Mar. 31, 2022

Related U.S. Application Data

(63) Continuation of application No. 12/337,268, filed on Dec. 17, 2008, now Pat. No. 11,110,332.

(60) Provisional application No. 61/014,330, filed on Dec. 17, 2007.

(51) Int. Cl.
*A63B 63/00* (2006.01)

(52) U.S. Cl.
CPC ..... *A63B 63/008* (2013.01)

(58) Field of Classification Search
CPC ..... A63B 63/008
See application file for complete search history.

(56) References Cited

U.S. PATENT DOCUMENTS 263,415 A 8/1882 Lightburne, Jr.
333,210 A 12/1885 Fisher
421,532 A 2/1890 Dorn
519,311 A 5/1894 Andrew
648,512 A 5/1900 Manley
1,071,585 A 8/1913 Rossell
1,267,117 A 5/1919 Riotte
1,645,218 A 10/1927 Boye
2,074,125 A 3/1937 Lefft et al.
2,151,146 A 3/1939 Petry
2,175,752 A 10/1939 Gray
(Continued)

OTHER PUBLICATIONS

International Preliminary Report on Patentability issued on Sep. 4, 2012 for International Application PCT/US2011/026746.
(Continued)

*Primary Examiner* — Jeffrey S Vanderveen
(74) *Attorney, Agent, or Firm* — Bradley Arant Boult Cummings LLP; Henry B. Ward, III

(57) ABSTRACT

Embodiments of the present invention provide a system, apparatus, and method that allow a football goalpost to be rotated about a substantially vertical axis. In an exemplary embodiment of the invention, the football goalpost has a gooseneck-type post adapted to fit within a sleeve in the ground. The sleeve generally has one or more positioning members positioned near an upper end of the sleeve. A rotation collar is movably coupled to the post and has one or more grooves for cooperating with the one or more positioning members of the sleeve. The rotation collar is configured to move between a secured position, where the at least one groove engages the at least one positioning member to prevent the post from rotating within the sleeve, and a rotating position, where the at least one groove is disengaged from the at least one positioning member to permit the post to rotate within the sleeve.

2 Claims, 23 Drawing Sheets

(56) References Cited

U.S. PATENT DOCUMENTS 2,216,408 A 10/1940 Elmer
2,246,891 A 6/1941 Moise
2,521,368 A 9/1950 Hingerty, Jr.
2,567,243 A * 9/1951 Smith ..... F16L 21/04 285/356
2,694,540 A 11/1954 Pfaff, Jr.
2,701,605 A 2/1955 Belmont
2,991,495 A * 7/1961 Blalack ..... A47L 23/16 248/161
3,083,680 A 4/1963 Willis, Jr. et al.
3,138,010 A 6/1964 Shipley et al.
3,209,720 A 10/1965 Campbell et al.
3,345,826 A 10/1967 Highite
3,418,009 A * 12/1968 Pollia ..... F16L 23/0286 403/336
3,443,827 A 5/1969 Aker et al.
3,516,666 A * 6/1970 Rottman ..... A63B 63/008 473/477
3,550,938 A * 12/1970 Cunningham, Jr. ... A63B 69/40 124/4
3,752,476 A * 8/1973 Mahoney ..... A63B 69/0097 248/188.7
3,802,653 A * 4/1974 Nyulassie ..... E04H 12/2253 52/27
3,820,787 A * 6/1974 Heinbigner ..... A63B 63/00 473/439
3,856,302 A 12/1974 Karkoska
3,981,501 A 9/1976 Gonzalez et al.
4,249,762 A * 2/1981 Richards ..... A63B 15/00 482/109
4,738,222 A * 4/1988 Terry ..... A01K 1/04 119/781
4,820,211 A 4/1989 Onoue
4,949,525 A * 8/1990 Weaver ..... E04H 12/32 403/379.3
5,025,598 A * 6/1991 Manna ..... E04H 6/10 403/174
5,037,093 A * 8/1991 Roark, Jr. ..... A63B 63/083 473/483
5,060,989 A * 10/1991 Gallucci ..... F16L 21/08 285/337
5,332,196 A * 7/1994 Wright ..... E04H 17/006 256/DIG. 5
5,513,843 A 5/1996 Russell
5,584,480 A 12/1996 Grimsrud
5,685,343 A 11/1997 Smith
6,202,369 B1 * 3/2001 Partee ..... E01F 9/685 40/607.04
6,202,639 B1 3/2001 Wu
6,375,585 B1 4/2002 Driscoll
6,389,917 B1 5/2002 Oberle
6,394,917 B1 * 5/2002 Chiappini ..... A63B 63/008 473/439
6,585,601 B2 7/2003 Booker et al.
6,915,913 B2 7/2005 Cardinell
6,945,885 B2 9/2005 Snider
7,014,578 B1 * 3/2006 Brodeur ..... A63B 63/008 473/439
7,278,894 B2 10/2007 Lyon et al.
7,331,880 B2 2/2008 Rogers
7,914,401 B2 3/2011 Hulbert
8,888,615 B2 * 11/2014 Hulbert ..... A63B 71/0036 473/477
2003/0171168 A1 * 9/2003 Hazelton ..... A63B 71/0054 473/415
2004/0121860 A1 * 6/2004 Hazelton ..... A63B 71/0054 473/415
2006/0199674 A1 * 9/2006 Rogers ..... A63B 71/023 473/446

OTHER PUBLICATIONS

Royal2013, Screenshots from Royal Highschool 2003-2004, highlights and screen shots of playing area, 12 pages.
International Search Report and the Written Opinion of the International Searching Authority mailed Nov. 22, 2011 for International Application No. PCT/US2011/026746; 8 pages.
Webpage screen shots, Rogers, 2004, www.youtube.com/watch?v=0PZzd6QGSic, 10 pages.
Assembly Instructions, Sportsfield, 2010, 11 pages.
Design Specifications for Model #SEF305 High School 8 FT Football Goal, published prior to Jun. 28, 2007, 2 pages, United States.
WVU President Asks Fans to Behave, Pittsburgh Tribune Review—Sports, Nov. 1, 2003, 2 pages, Associated Press, United States.
Athletic Tools and Equipment, web pages from www.courtandsports.com, published prior to Jul. 17, 2007, 2 pages, United States.
Miscellaneous Hardware Specifications and Installation Instructions, published prior to Dec. 17, 2007, 6 pages, Sportsfield Specialties Inc., United States.
Hinged Goal Post—Gilman Gear Online Store, web pages from www.nexternal.com, published prior to Jul. 17, 2007, 2 pages, United States.

* cited by examiner

FOOTBALL GOALPOST ROTATION APPARATUS AND METHOD

CROSS-REFERENCE TO RELATED APPLICATIONS

This application is a continuation of U.S. patent application Ser. No. 12/337,268 entitled "FOOTBALL GOALPOST ROTATION APPARATUS AND METHOD" filed on Dec. 17, 2008 which published as U.S. App. Pub. No. 2008/0156334A1, which claims the benefit of U.S. Provisional Patent Application Ser. No. 61/014,330 entitled "FOOTBALL GOALPOST ROTATION APPARATUS AND METHOD" filed on Dec. 17, 2007, all of which are hereby incorporated by reference in its entirety.

FIELD

The invention generally relates to the field of sporting goal structures, and more particularly, embodiments of the present invention relate to an apparatus and method for rotating a football goalpost about a substantially vertical axis.

BACKGROUND

Football is an enormously popular sport in the United States. All across the country, playing fields are frequently designed to facilitate football games. Located at either end of the playing field, a football goalpost has a generally U-shaped goal defined by a horizontal crossbar and two vertical uprights. The U-shaped goal is usually supported by a gooseneck base extending up from the ground.

In many instances, however, this gooseneck configuration (and the football goalpost itself) obstructs the ability of athletic facility personnel to convert a football playing field into a field suitable for other sporting events or purposes. This problem is particularly apparent when personnel must convert a football field into a soccer field. Because a soccer field is substantially the same size as a football field, the football goalposts (which have no use in a soccer game) tend to be a nuisance. Although football goalposts often are removable from ground sleeves, the removal process can be unreasonably time-consuming and labor intensive, especially since soccer and football games may be played back-to-back. As a result, personnel usually position each soccer goal directly under each football goalpost. Positioned as such, the upper crossbar of the soccer goal is usually located only slightly below, e.g., twenty-four inches below, the football goalpost's crossbar. This configuration has many drawbacks. For example, this configuration may make it difficult for soccer referees to distinguish between a soccer ball striking the football goalpost's crossbar (out of bounds) and striking the upper crossbar of the soccer goal (in play).

Accordingly, there is a long-felt but unmet need to provide a system that enables facility personnel to quickly and easily move or otherwise reconfigure a football goalpost such that the football goalpost's crossbar is substantially remote from the upper crossbar of a soccer goal.

BRIEF SUMMARY OF EMBODIMENTS OF THE INVENTION

Embodiments of the invention solve the above-described problem and/or other problems by providing a system, apparatus, and method that allows a football goalpost to be rotated about a substantially vertical axis. In this way, the football goalpost's crossbar may be moved to a location where it will not significantly interfere with the upper crossbar of a soccer goal. In an exemplary embodiment of the invention, the football goalpost has a gooseneck-type post adapted to fit within a sleeve in the ground. The sleeve generally has one or more positioning members positioned near an upper end of the sleeve. A rotation collar is movably coupled to the post and has one or more grooves for cooperating with the one or more positioning members of the sleeve. The rotation collar is configured to move between (1) a secured position where the at least one groove engages the at least one positioning member to prevent the post from rotating within the sleeve, and (2) a rotating position where the at least one groove is disengaged from the at least one positioning member to permit the post to rotate within the sleeve.

For example, one embodiment of the invention provides a goalpost rotation apparatus for permitting a football goalpost to be rotated within a sleeve anchored in the ground, where the goalpost rotation apparatus includes a first engaging device configured to be coupled to the sleeve and a rotation collar. The rotation collar has an opening structured to receive the goalpost and a second engaging device structured to releasably engage the first engaging device. The rotation collar is structured so that, when the rotation collar is coupled to the goalpost, the rotation collar is permitted to move, relative to the goalpost, along a longitudinal axis of the goalpost but is substantially fixed with respect to the ability to rotate, relative to the goalpost, about the longitudinal axis of the goalpost.

In some embodiments of the apparatus, the first engaging device comprises at least one shaft structured such, when the first engaging device is coupled to the sleeve, the shaft extends outward from the sleeve generally perpendicular to the sleeve. In such an embodiment, the second engaging device includes at least one groove structured to receive the shaft.

In one embodiment of the apparatus, the first engaging device comprises a generally cylindrical locating collar having an opening therein structured for receiving the sleeve and at least one positioning member extending outward from the locating collar. In such an embodiment, the rotation collar has a generally cylindrical chamber configured to receive the generally cylindrical locating collar. The second engaging device of the rotation collar comprises at least one groove structured to releasably engage the at least one positioning member to prevent the rotation collar from rotating with respect to the locating collar. In general, the opening in the generally cylindrical locating collar is larger than the diameter of the sleeve that the locating collar is configured to receive.

In some embodiments, the generally cylindrical locating collar comprises a plurality of threaded apertures structured to receive a plurality of bolts for providing a user with the ability to adjust the location of the locating collar relative to the sleeve and fix the locating collar to the sleeve. In one embodiment, the at least one positioning member extending outward from the locating collar is comprised of the plurality of bolts. In one embodiment, the first engaging device comprises a plurality of bolts extending outward from the sleeve, and the second engaging device comprises a plurality of grooves structured to receive the bolts.

In general, the generally cylindrical locating collar comprises a first opening on a first end and a second opening on a second end opposite said first end. The first opening is structured to receive the sleeve, and the second opening is smaller than said first opening, is structured to receive the goalpost, and has a diameter larger than, but substantially equal to, the diameter of the goalpost.

In some embodiments, the rotation collar comprises an elongate slot having a length and a width. In such an embodiment, the goalpost rotation apparatus further comprises a slot member structured so that it can be affixed to the surface of the goalpost and extend into the elongate slot in the rotation collar. The slot member has a length and a width. The width of the slot member is generally less than, but substantially similar to, the width of the elongate slot so that, when the slot member extends into the elongate slot, the rotation collar is substantially fixed with respect to the ability to rotate, relative to the goalpost, about the goalpost's longitudinal axis. The length of the slot member is generally significantly less than the length of the elongate slot so that, when the slot member extends into the elongate slot, the rotation collar is permitted to move along the longitudinal axis of the goalpost.

In some embodiment, the goalpost rotation apparatus includes a cylindrical locating collar having an outside diameter and a first opening on a first end and a second opening on a second end opposite said first end. The first opening is generally structured to receive the sleeve and has a diameter larger than the diameter of the sleeve. The second opening is structured to receive the goalpost and generally has a diameter larger than the diameter of the goalpost. The cylindrical locating collar is structured such that it can be fixed to the sleeve and comprises the first engaging device. The rotation collar further comprises a first tubular portion and a second tubular portion. The first tubular portion is configured to receive the goalpost therethrough and has an inside diameter larger than, but substantially equal to, the outside diameter of the goalpost. The second tubular portion is coupled to the first tubular portion, and is configured to receive the cylindrical locating collar. In general, the second tubular portion has an inside diameter larger than, but substantially equal to, the outside diameter of the cylindrical locating collar.

Embodiments of the present invention also provide an apparatus for permitting selective rotation and securing of a post in the ground. For example, in one embodiment the apparatus includes: (1) a sleeve comprising at least one positioning member extending therefrom, the sleeve configured to be anchored into the ground a post adapted to fit within the sleeve; and (2) a rotation collar coupled to the post. The rotation collar comprises at least one groove for cooperating with the at least one positioning member. The rotation collar is configured so that it can be moved between a secured position where the at least one groove engages the at least one positioning member to prevent the post from rotating within the sleeve, and a rotating position where the at least one groove is disengaged from the at least one positioning member to permit the post to rotate within the sleeve.

In one embodiment, the rotation collar is movably coupled to the post and is configured to move relative to the post between the secured position and the rotating position. For example, in one embodiment the rotation collar comprises a first tubular portion structured to receive the post therethrough, where the first tubular portion has an inside diameter larger than, but substantially equal to, the outside diameter of the post so that the rotation collar may slide relative to the post in a direction substantially parallel to a longitudinal axis of the post. In some embodiment, although the apparatus is structured such that the rotation collar is permitted to slide relative to the post in a direction substantially parallel to a longitudinal axis of the post, the apparatus is further structured such that it is substantially fixed with respect to the ability to rotate, relative to the post, about the longitudinal axis of the post.

Embodiments of the invention also provide various methods, such as a method of rotating a football goalpost. For example, one embodiment of the invention provides a method involving: (1) providing a sleeve comprising one or more positioning members; (2) providing a post adapted to fit within the sleeve, the post defining a longitudinal axis; (3) providing a rotation collar movably coupled to the post and configured such that the rotation collar is permitted to move along the longitudinal axis of the post but is substantially fixed with respect to the ability to rotate about the longitudinal axis with respect to the post, wherein the rotation collar comprises one or more grooves for cooperating with the one or more positioning members; (4) moving the rotation collar along the longitudinal axis of the post from a secured position where at least one of the one or more grooves engages at least one of the one or more positioning members to a rotating position where the at least one groove is disengaged from the first positioning member; (5) rotating the post within the sleeve; and (6) after rotating the post within the sleeve, returning the rotation collar to a secured position where at least one of the one or more grooves engages at least one of the one or more positioning members. The method of may further include adjusting the verticality of the goalpost in the sleeve by adjusting the one or more positioning members.

BRIEF DESCRIPTION OF THE SEVERAL VIEWS OF THE DRAWINGS

Figure 1B:
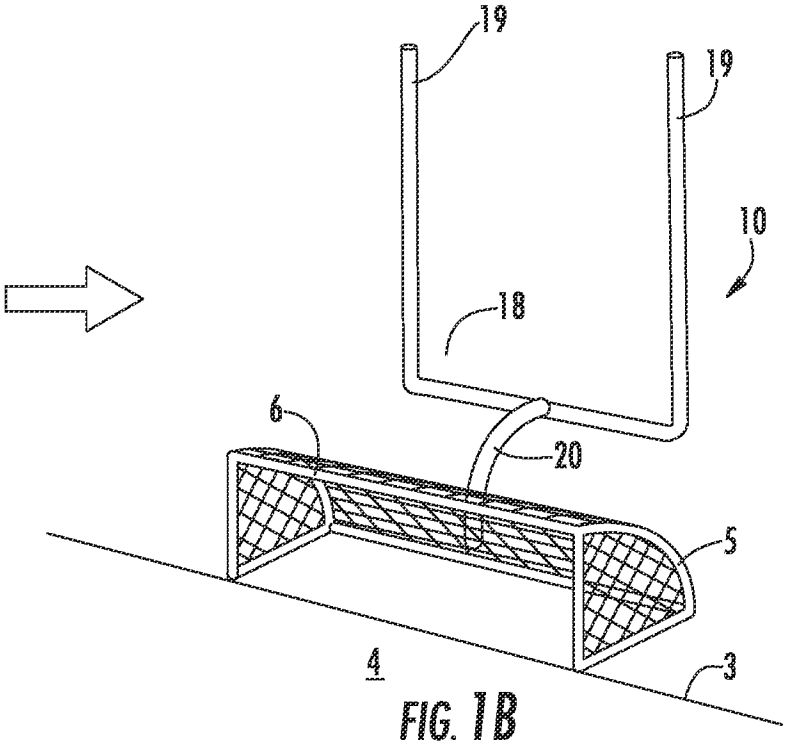
Figure 1A:
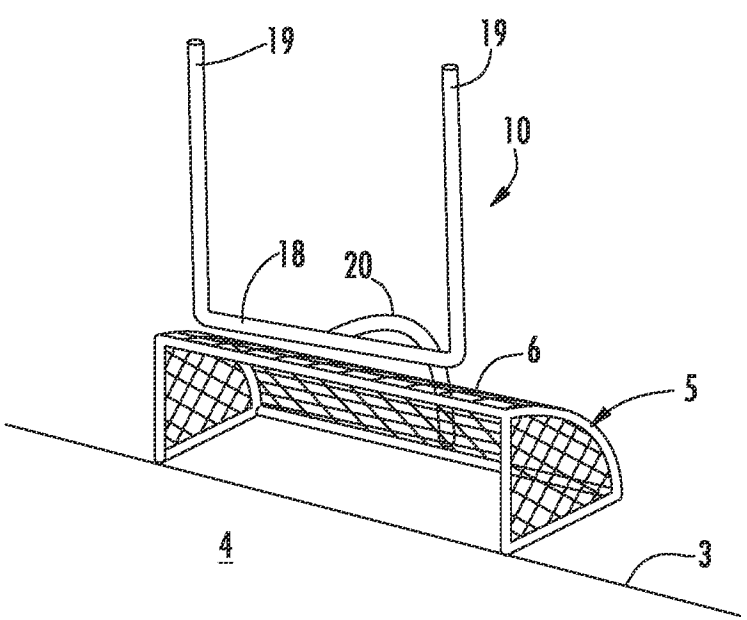
Figure 2:
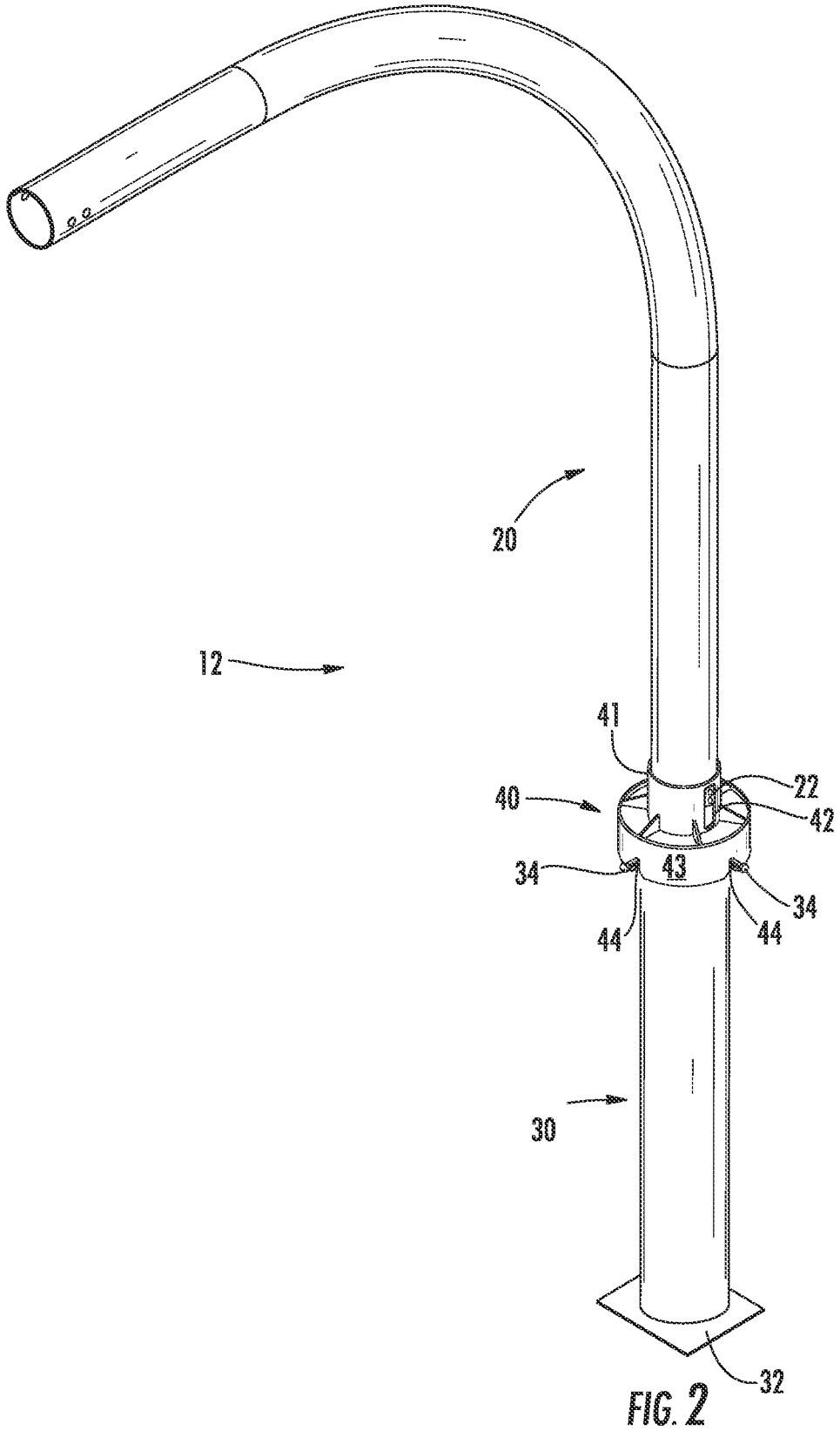
Figure 3:
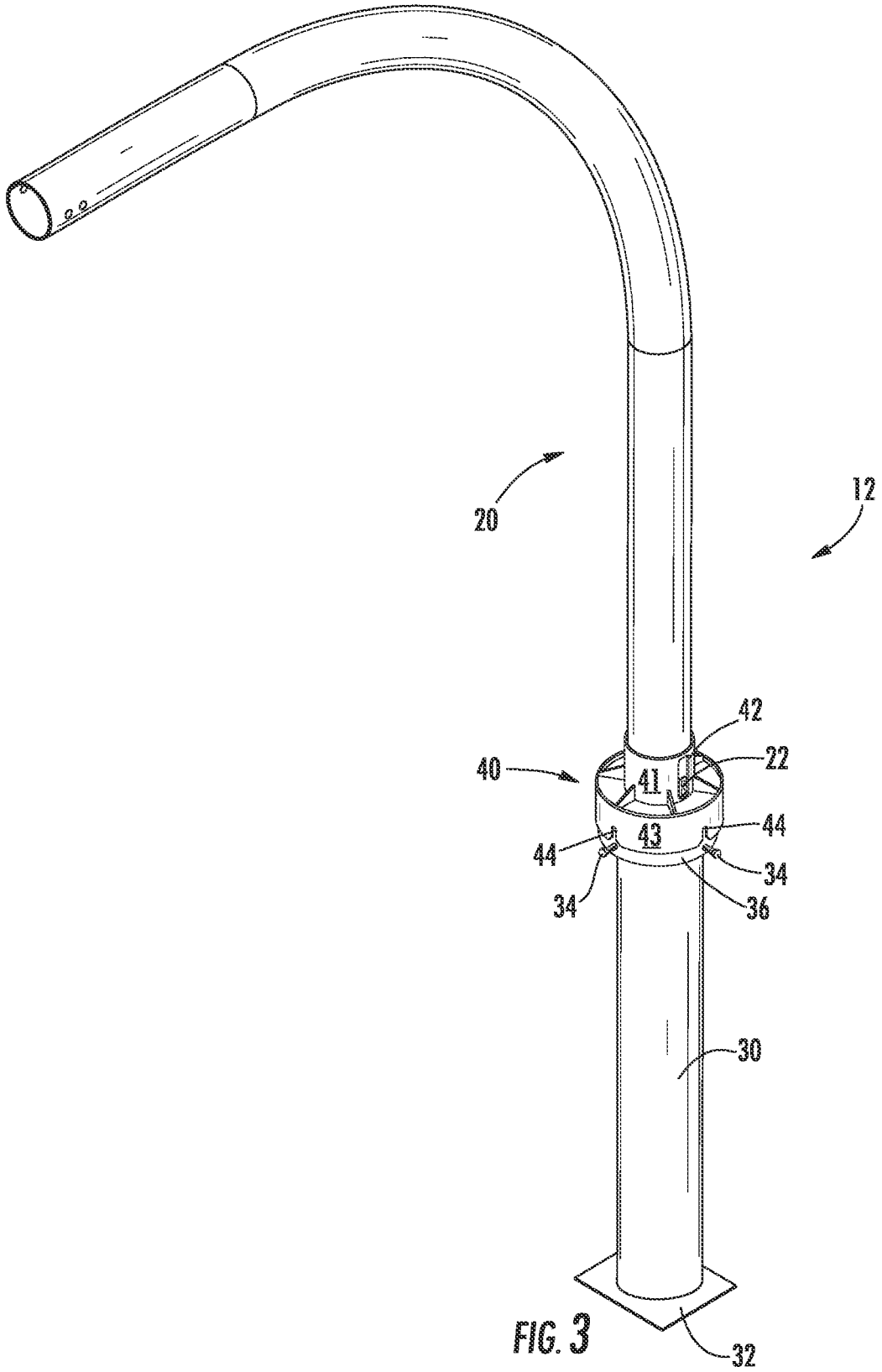
Figure 4:
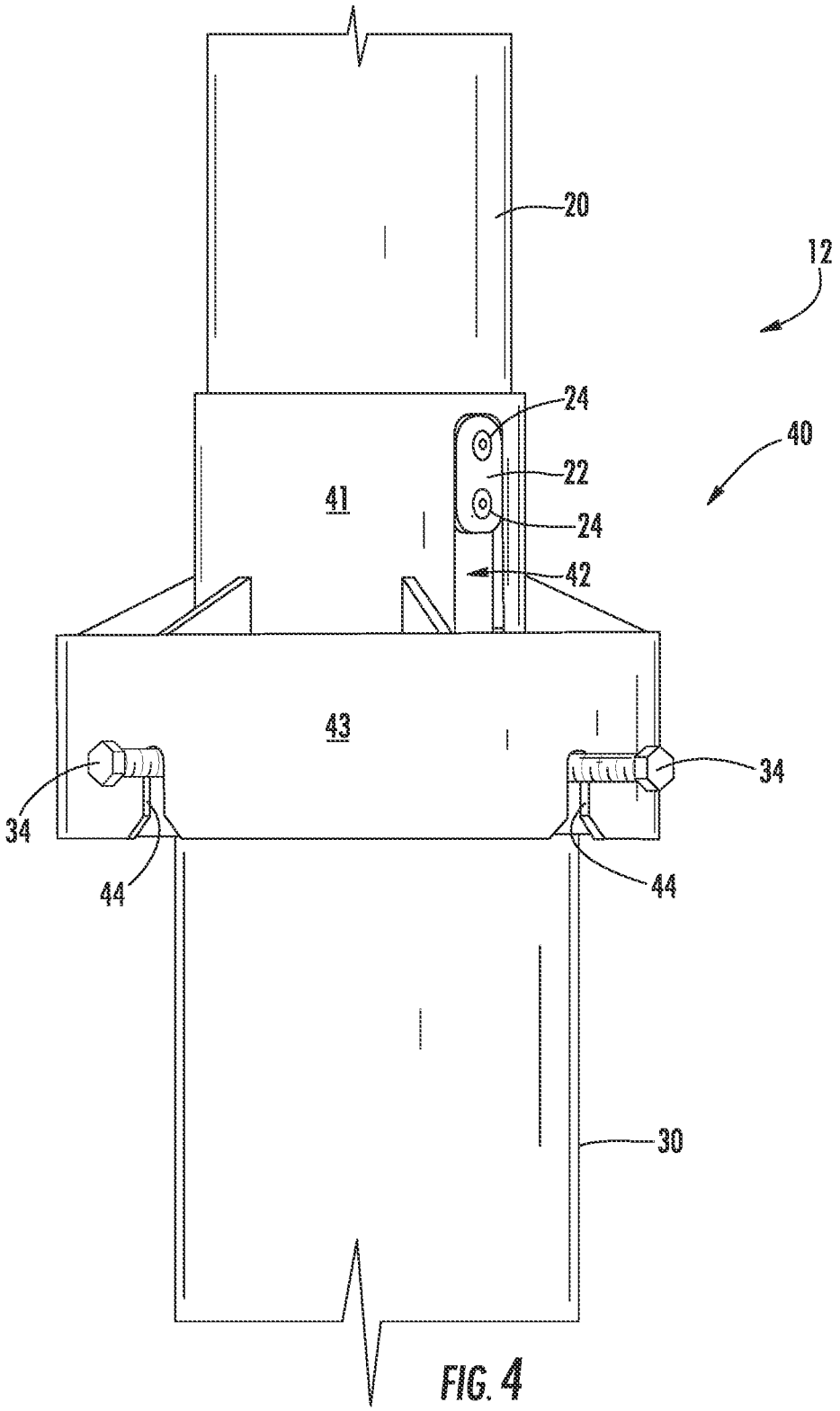
Figure 5:
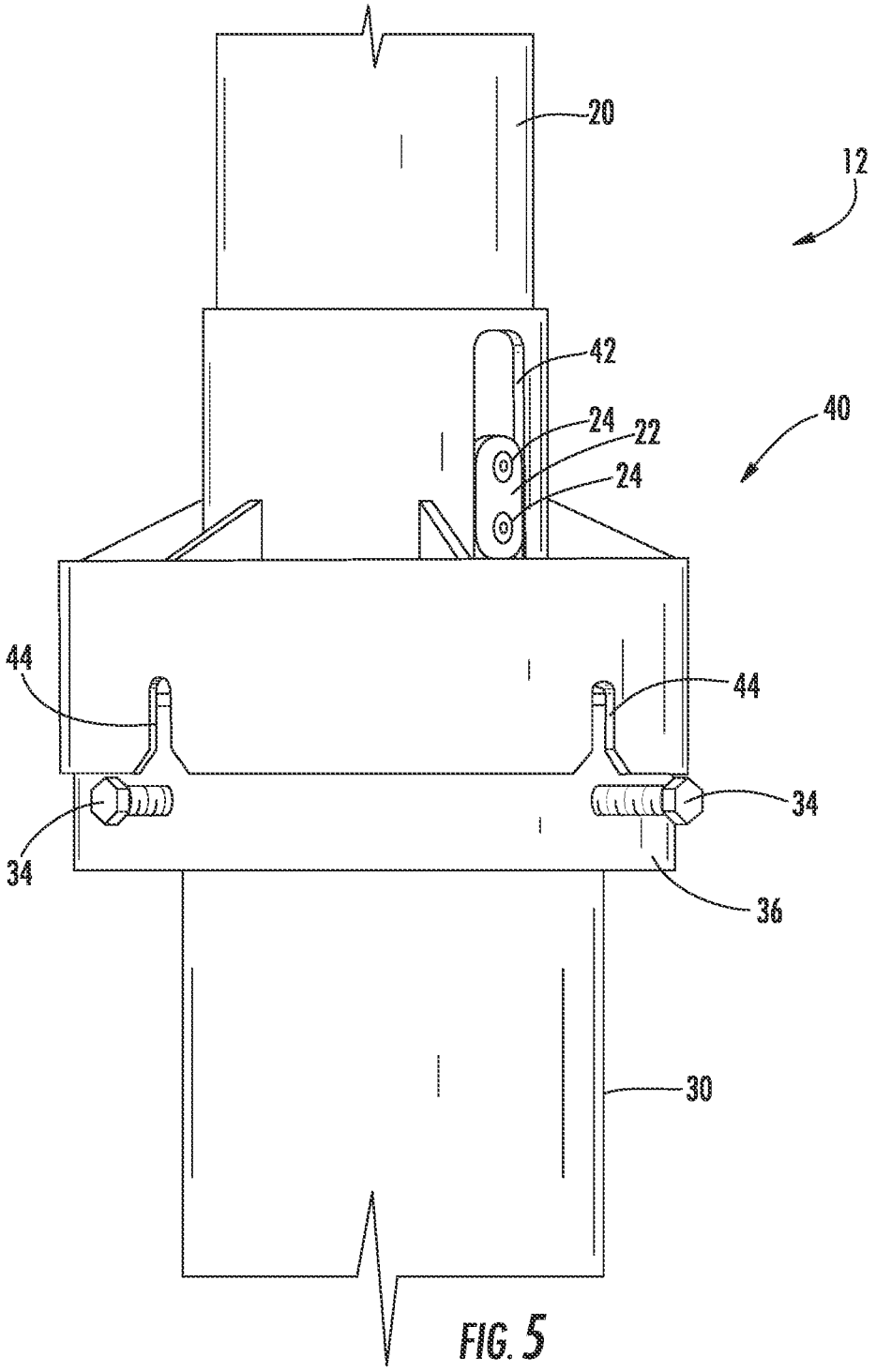
Figure 6:
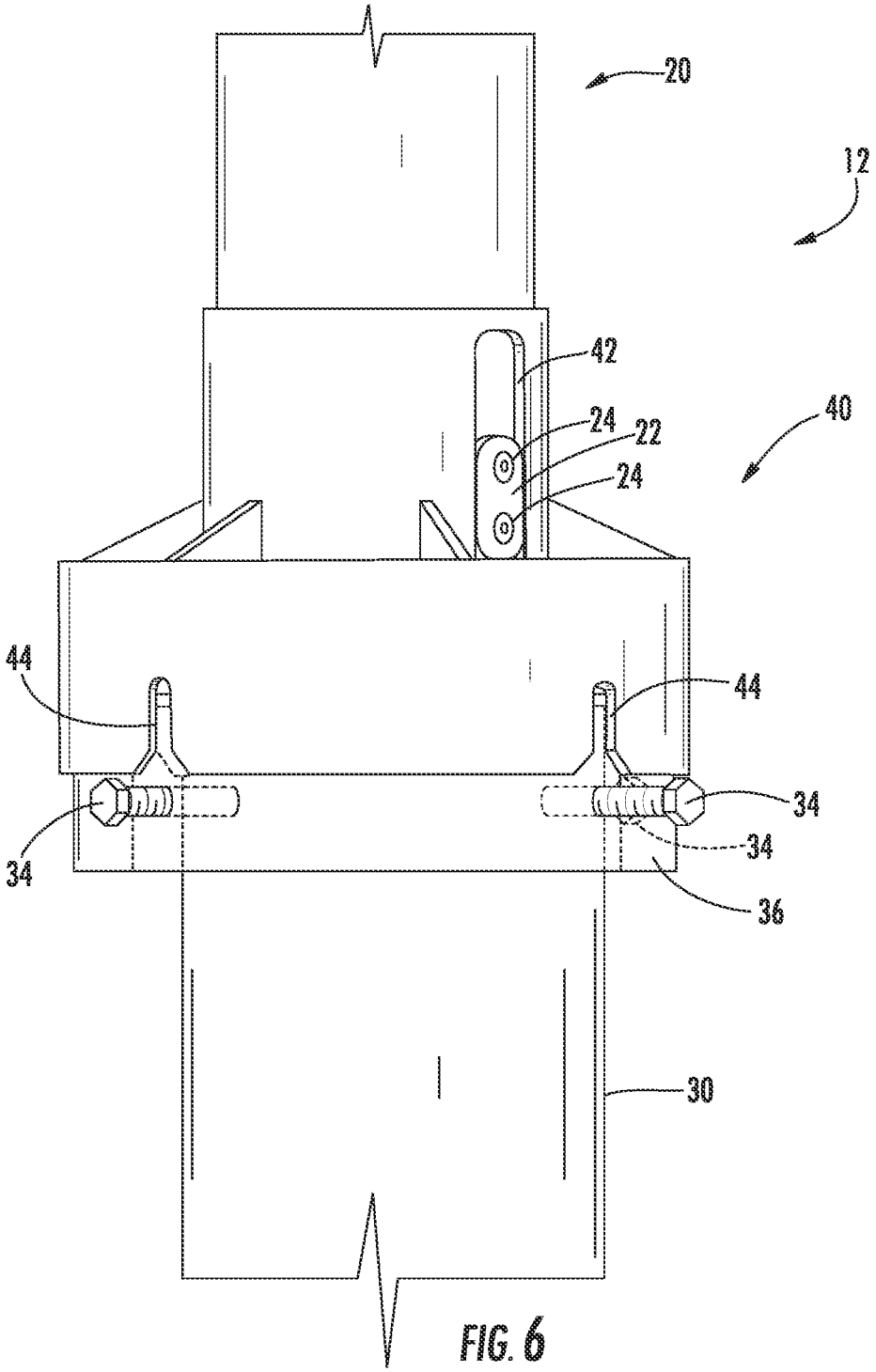
Figure 7:
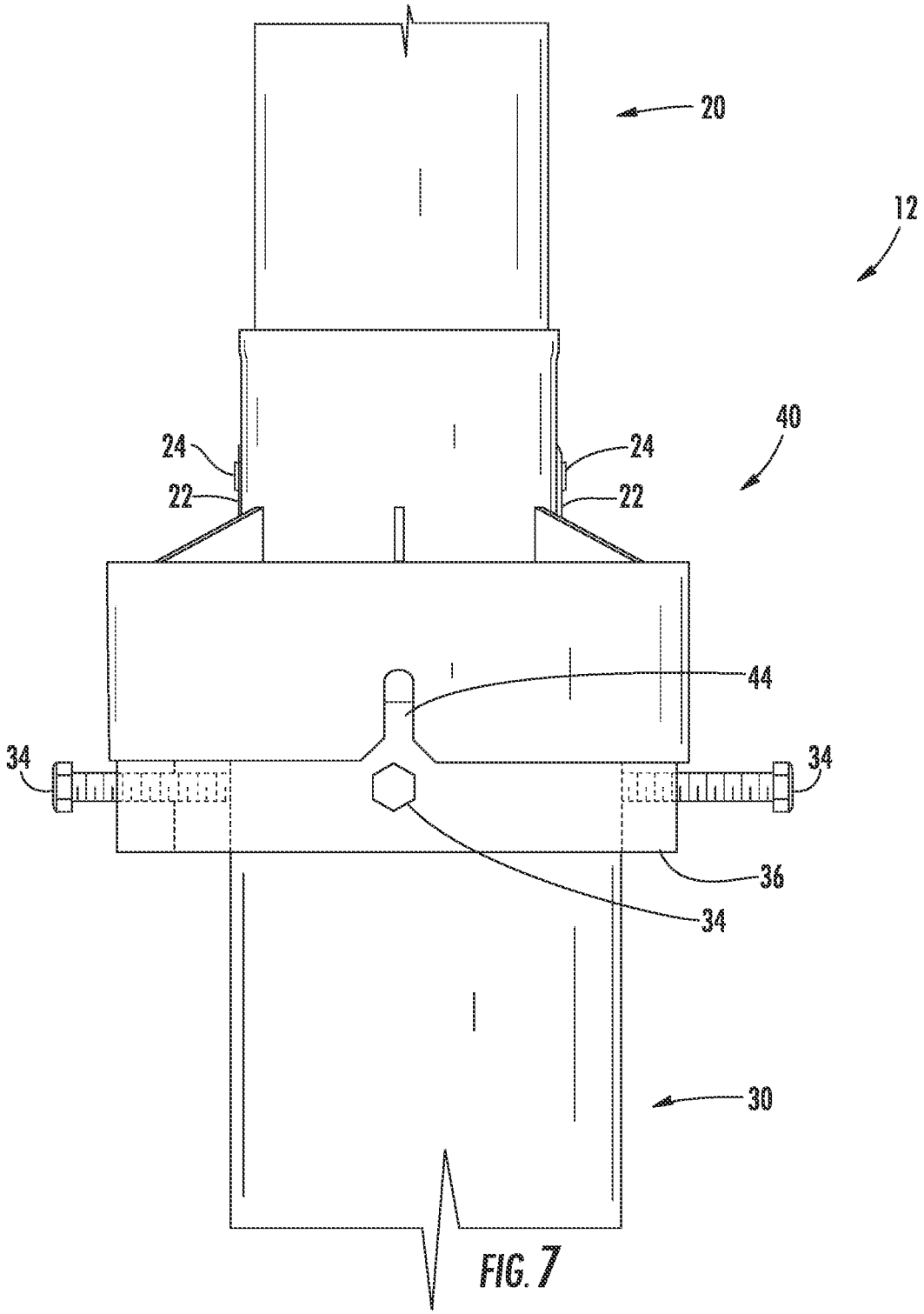
Figure 8:
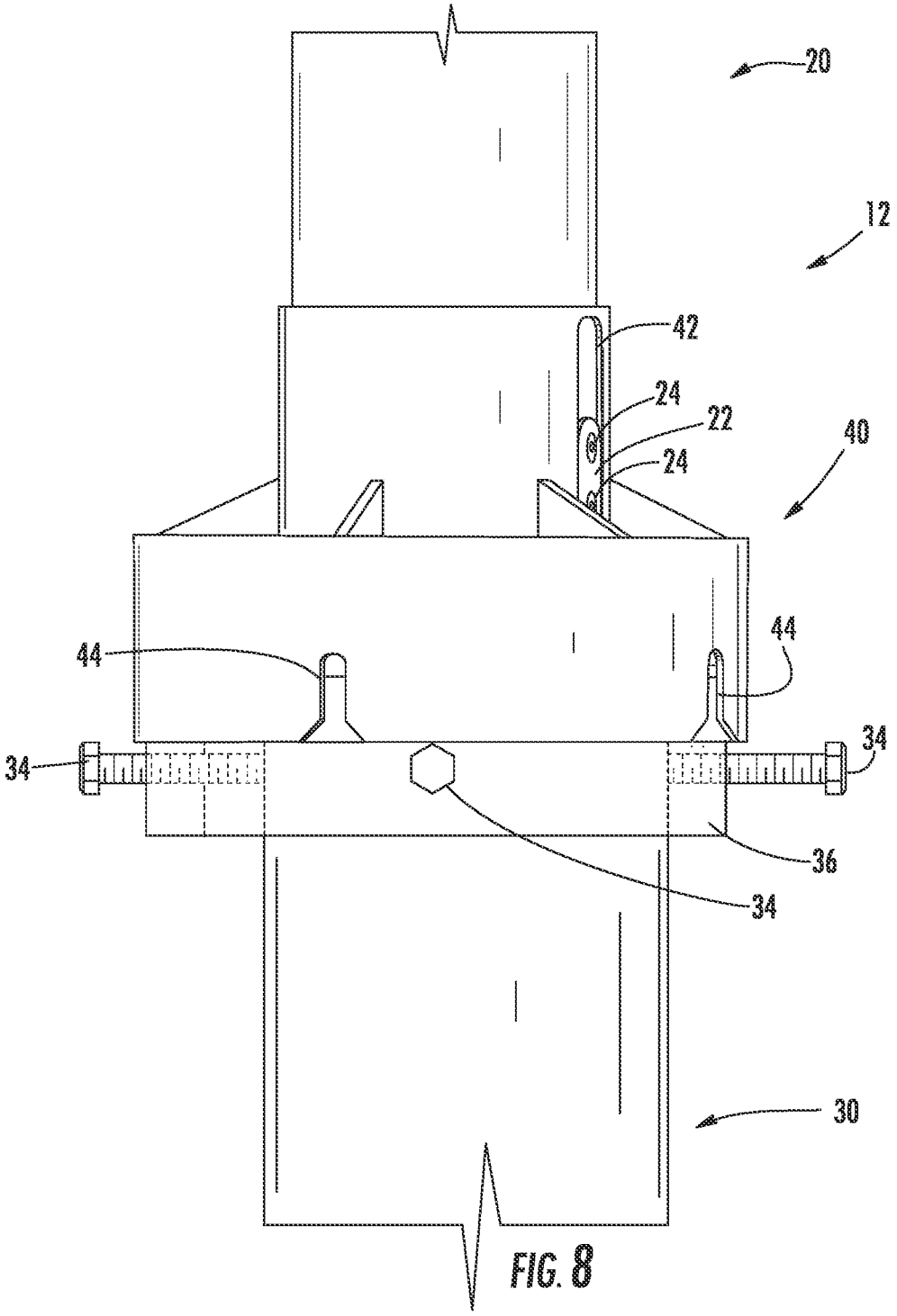
Figure 9:
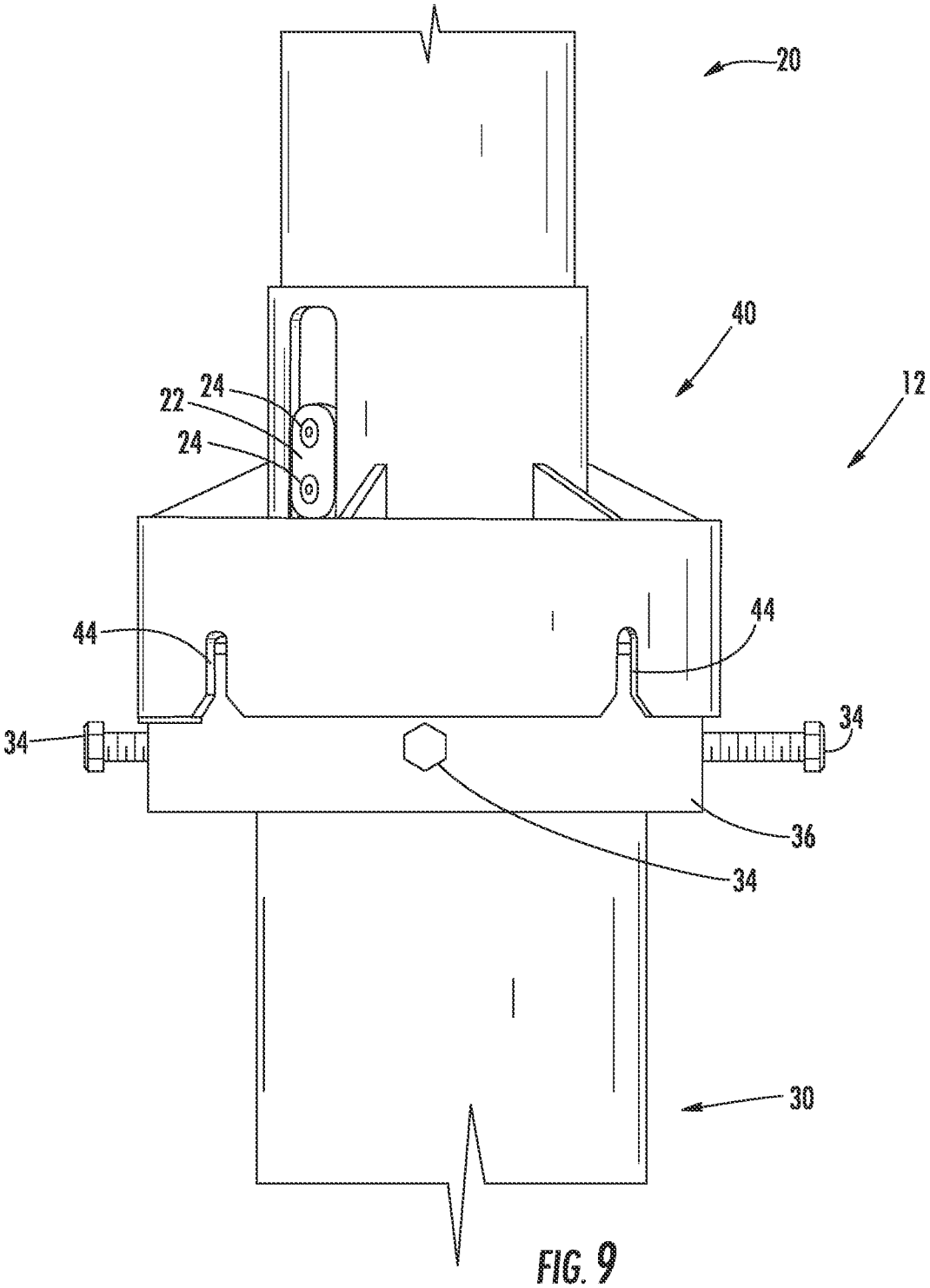
Figure 10:
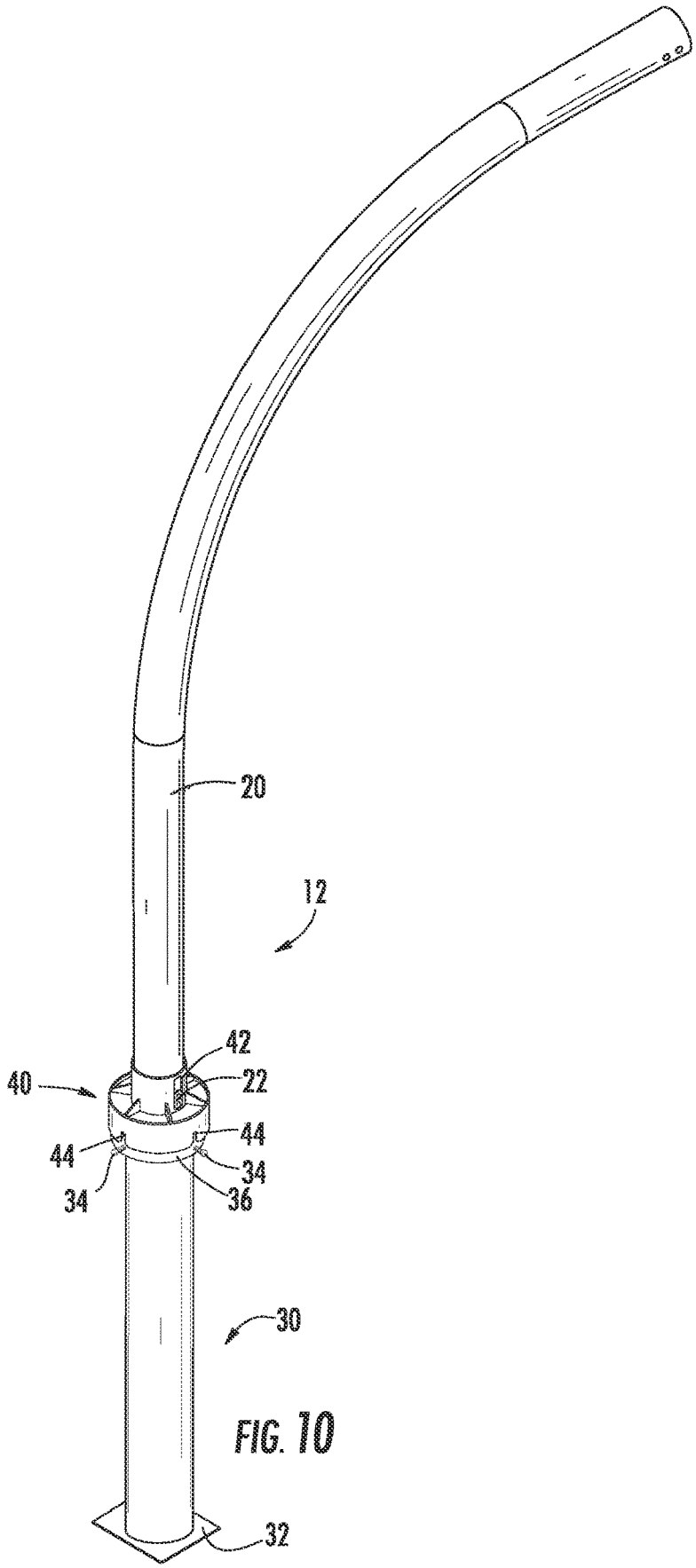
Figure 11:
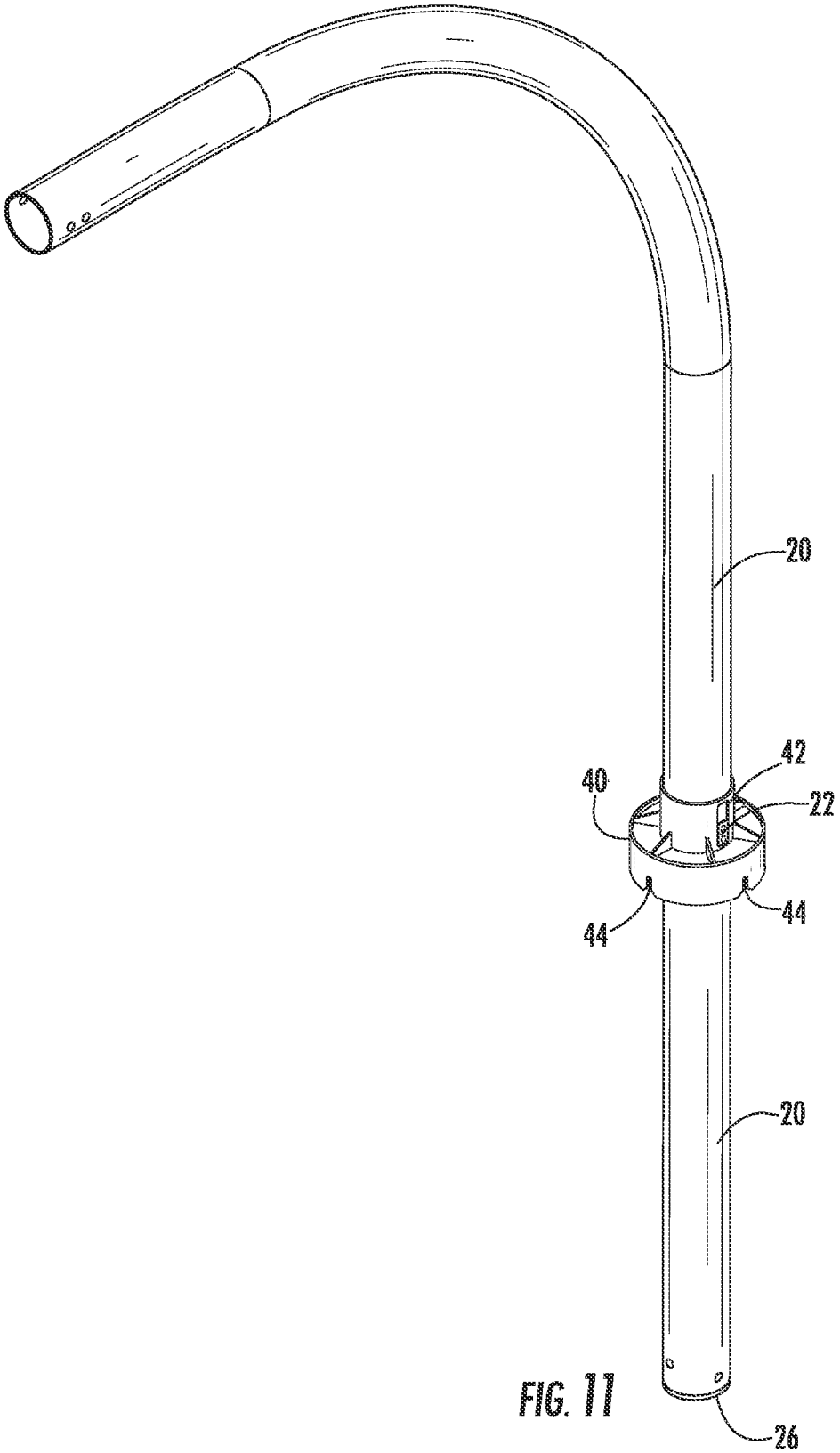
Figure 12:
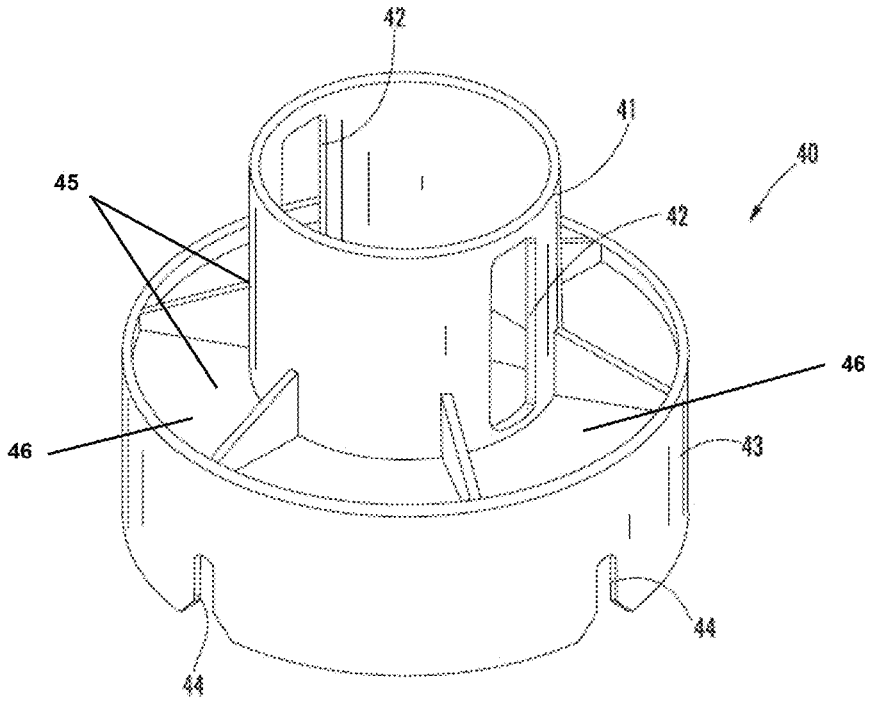
Figure 13:
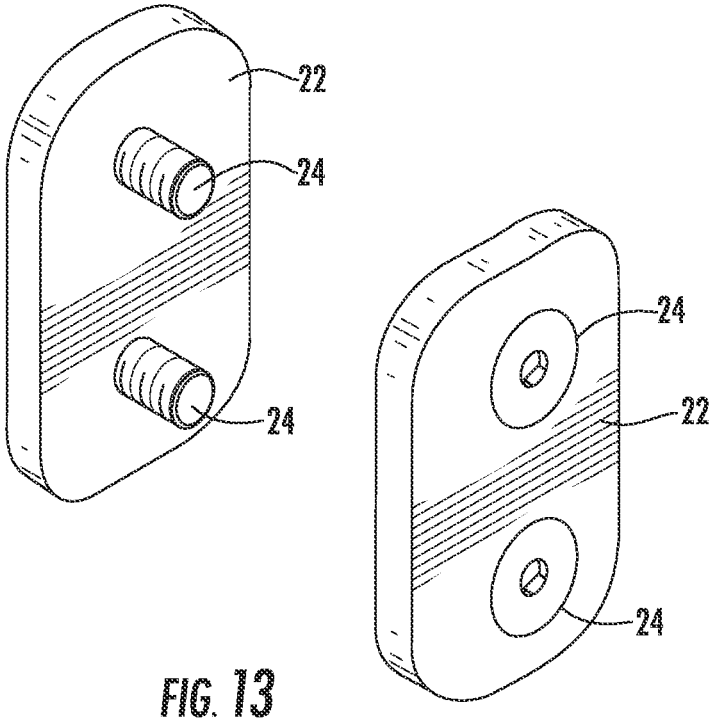
Figure 14:
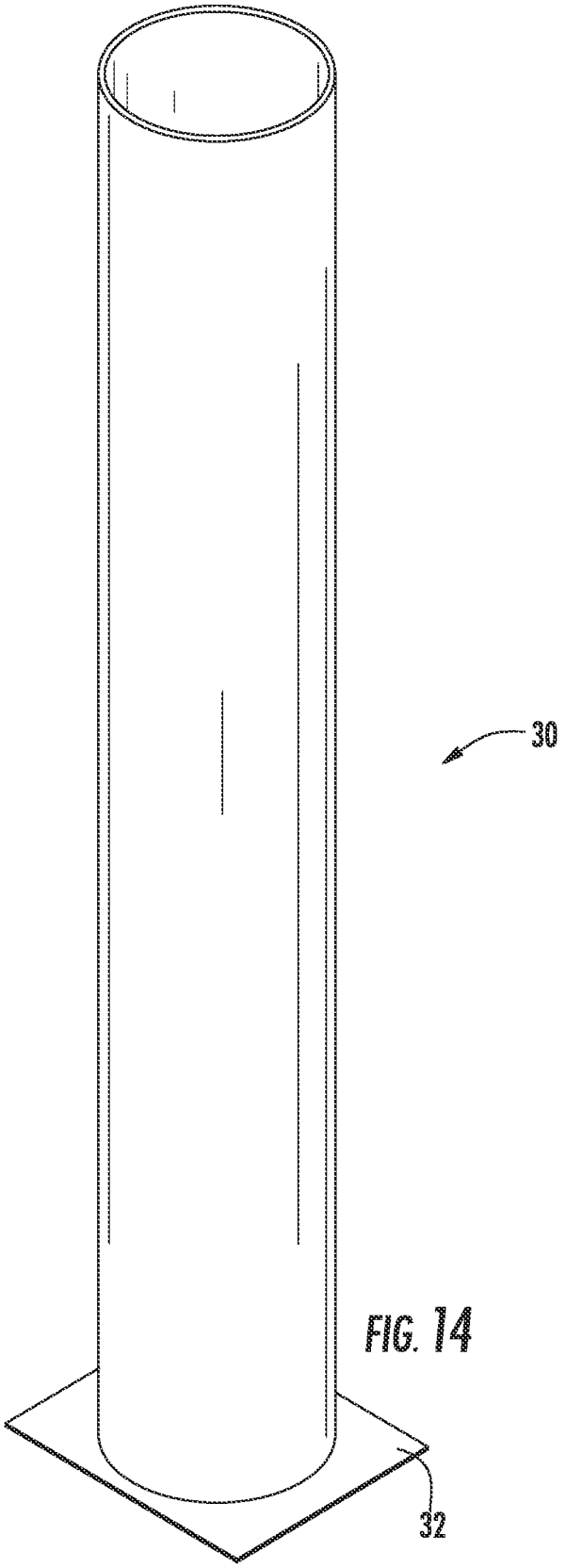
Figure 15:
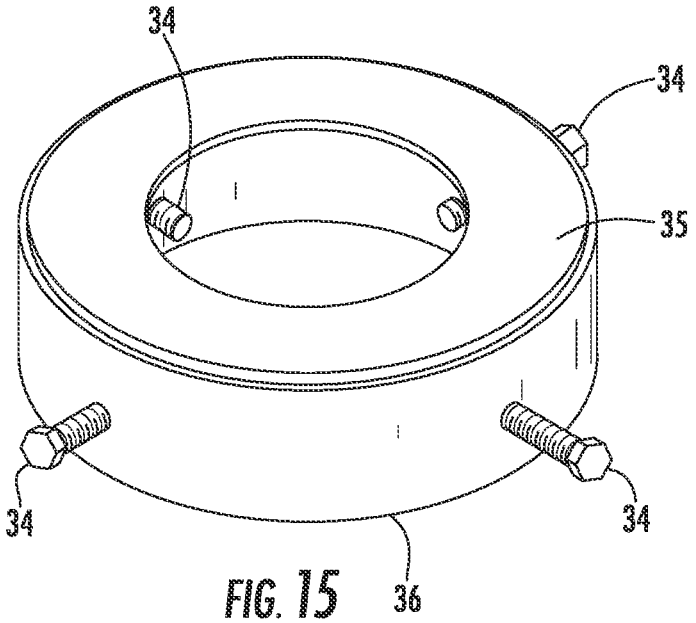
Figure 16:
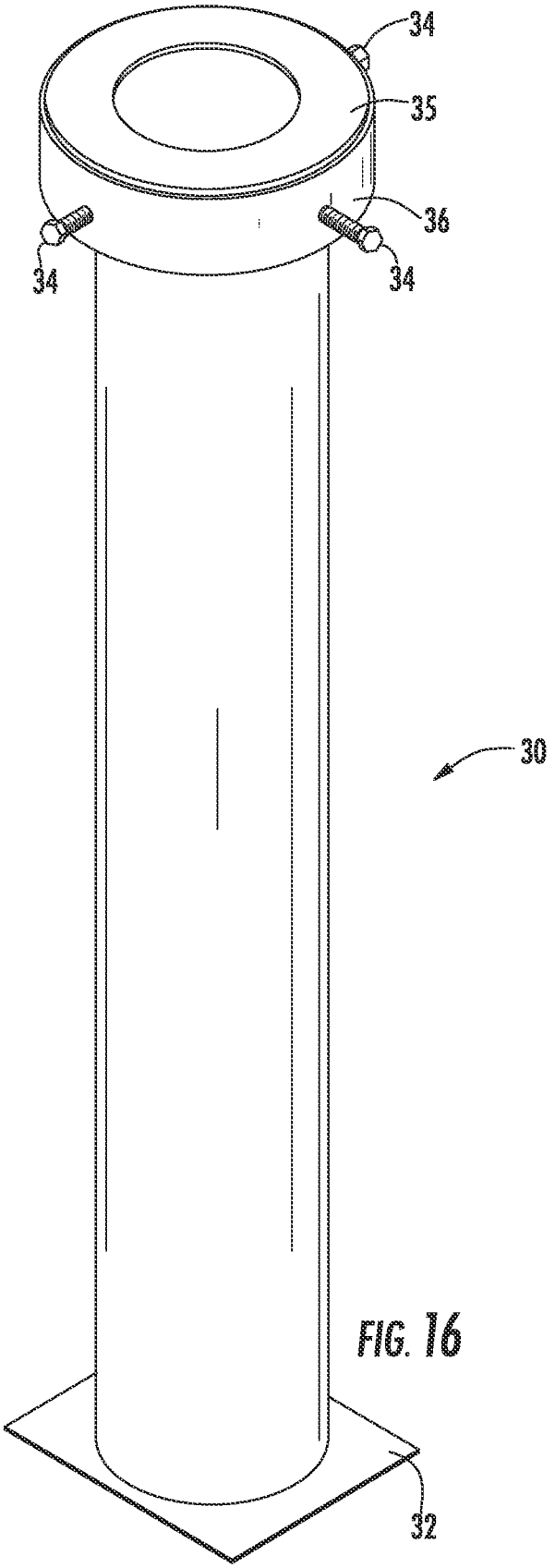
Figure 17:
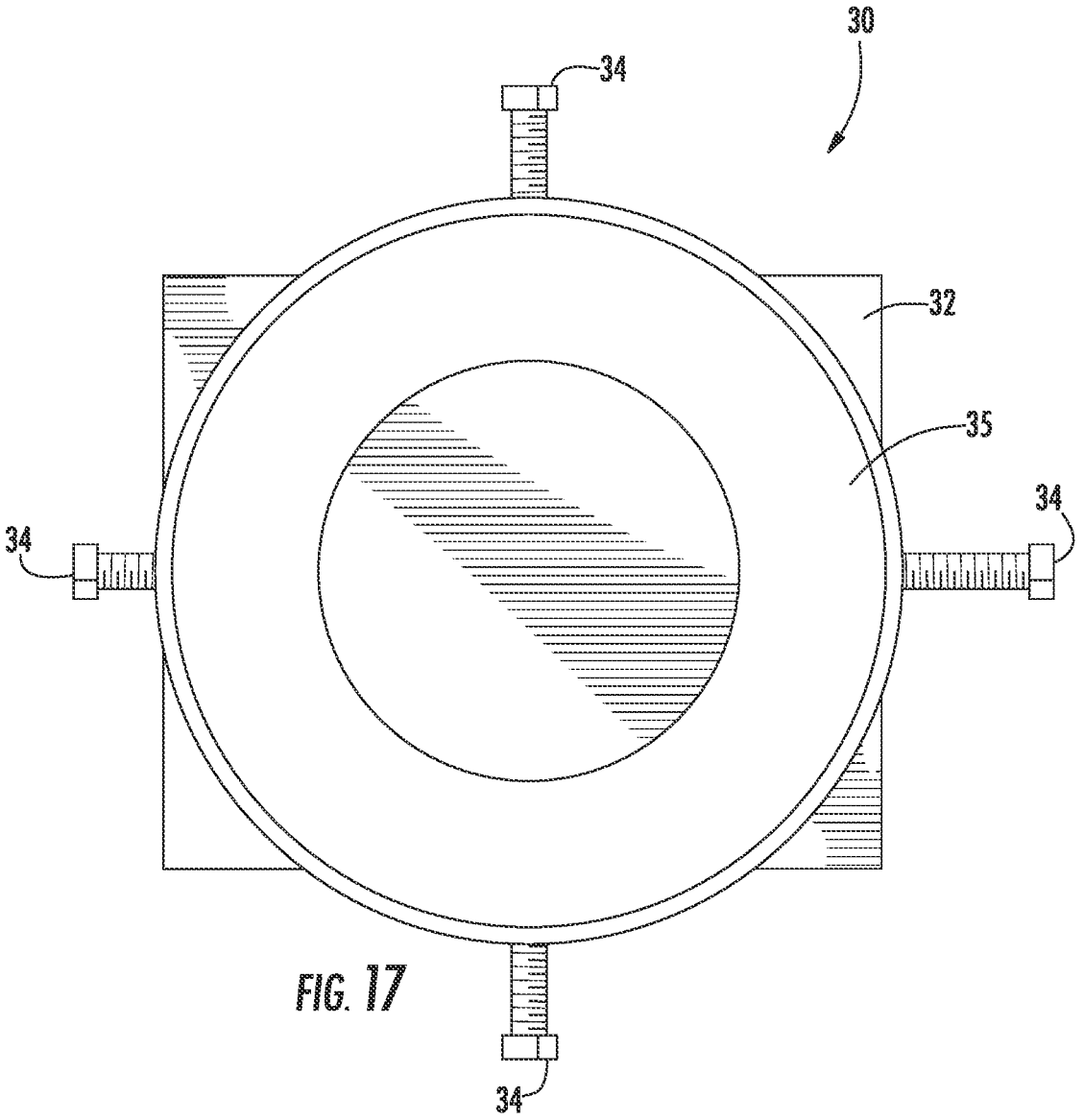
Figure 18:
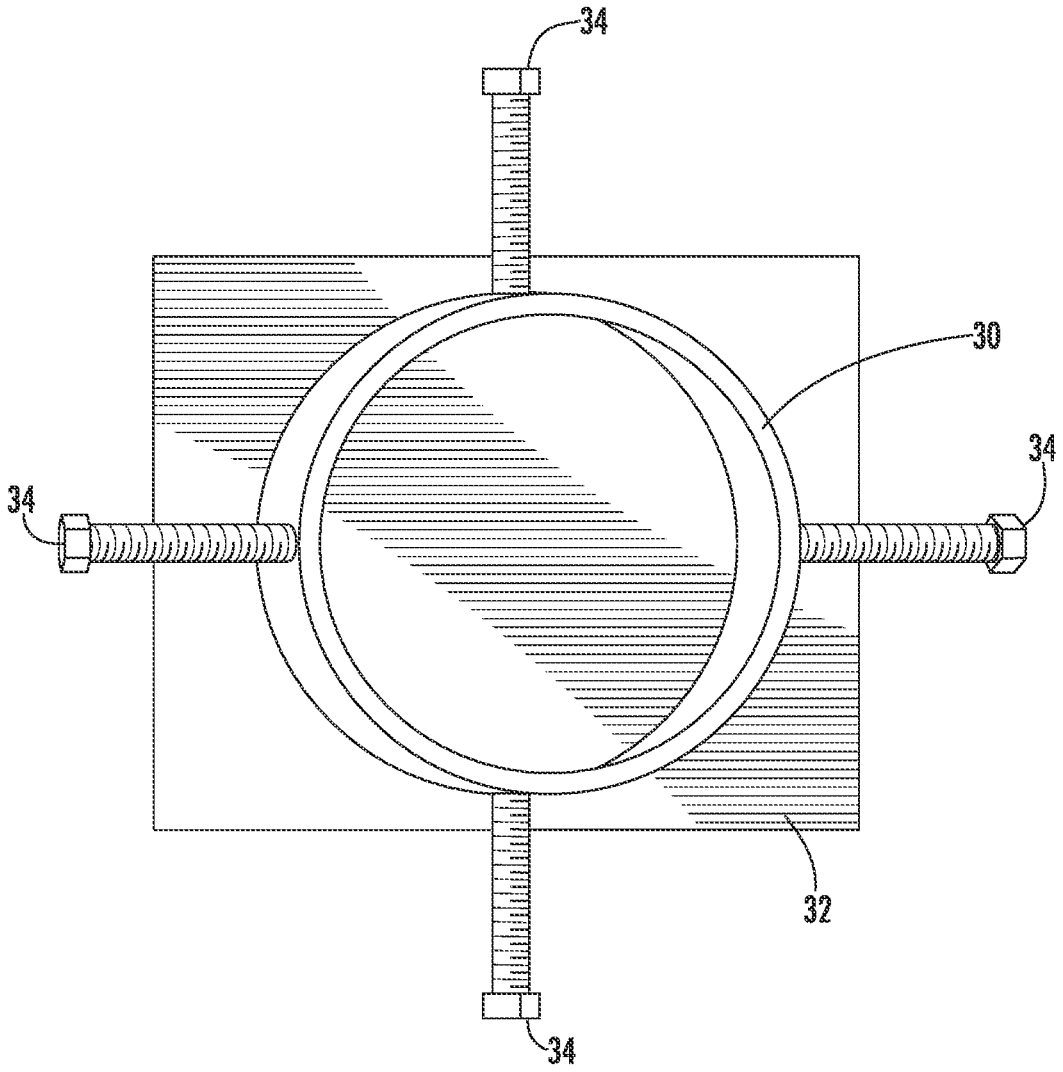
Figure 19:
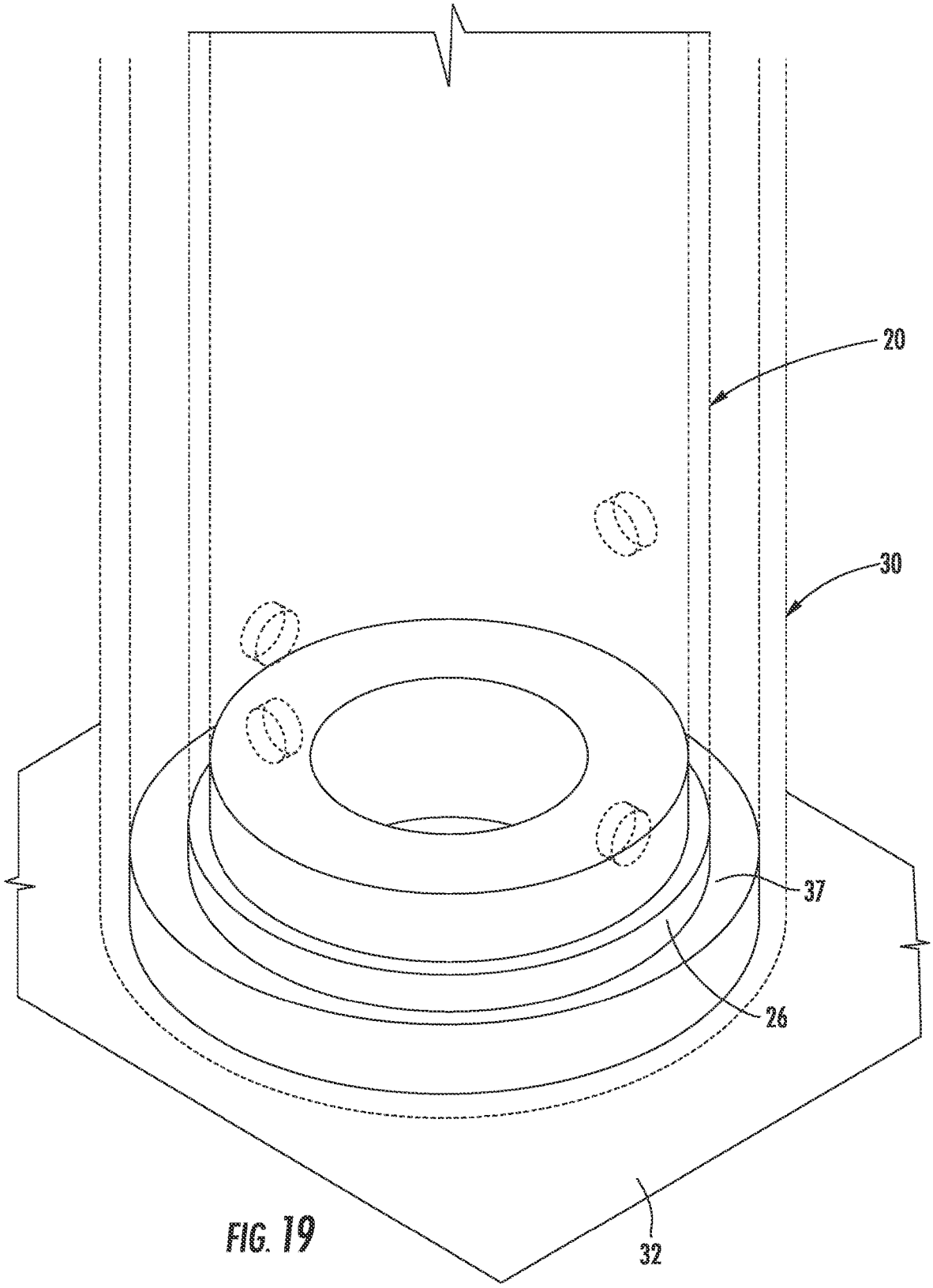
Figure 20:
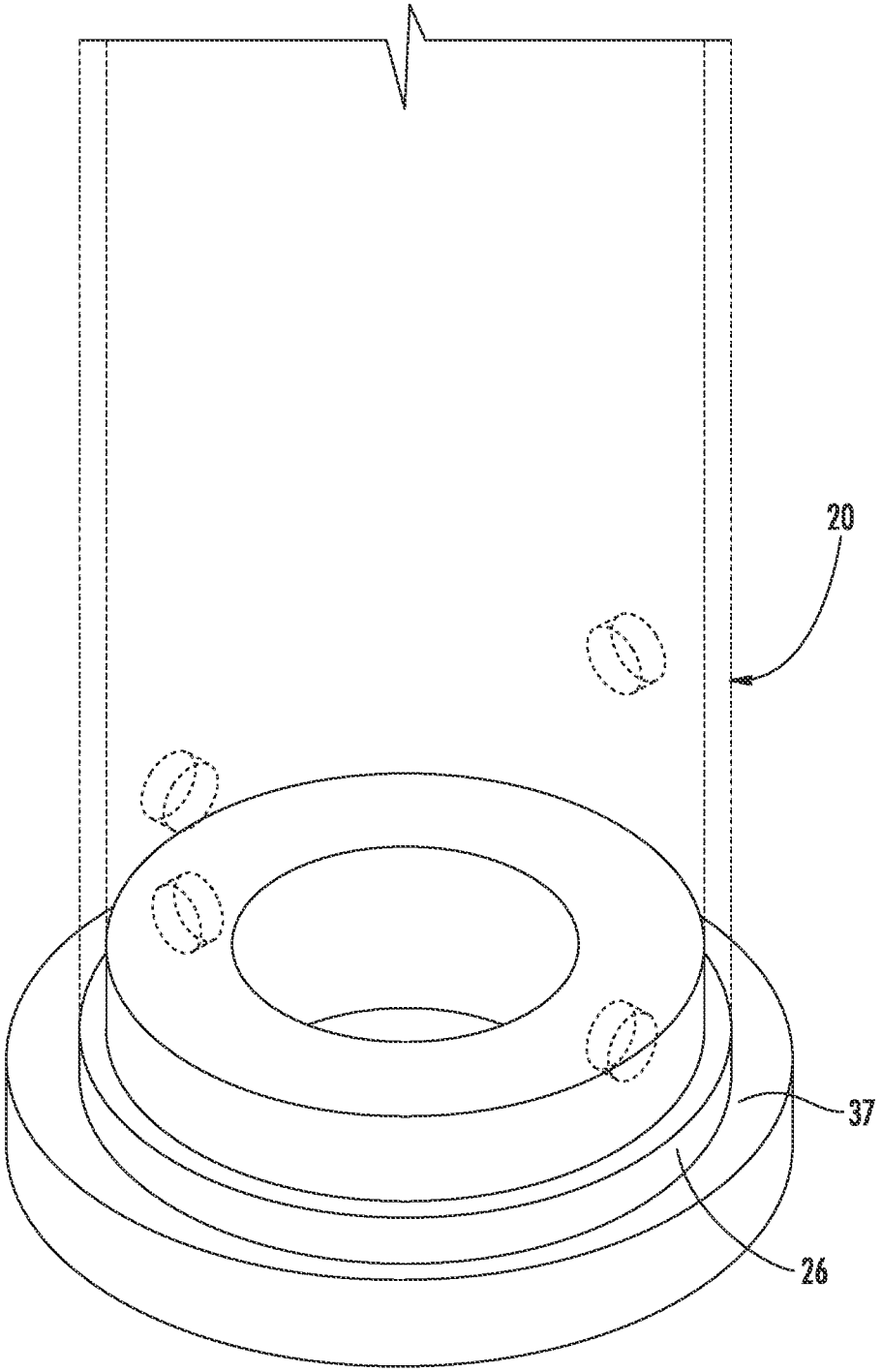
Figure 21:
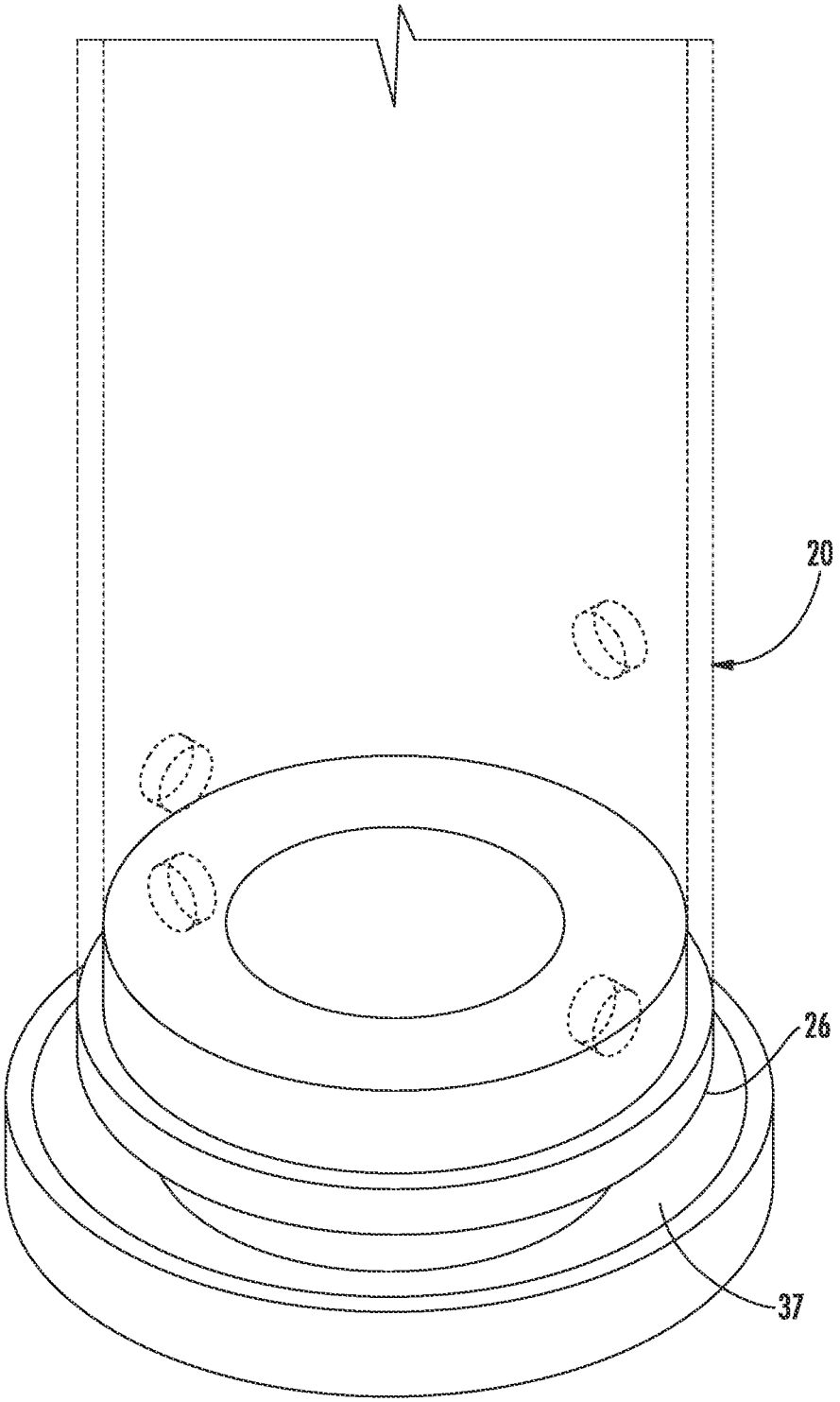
Figure 22:
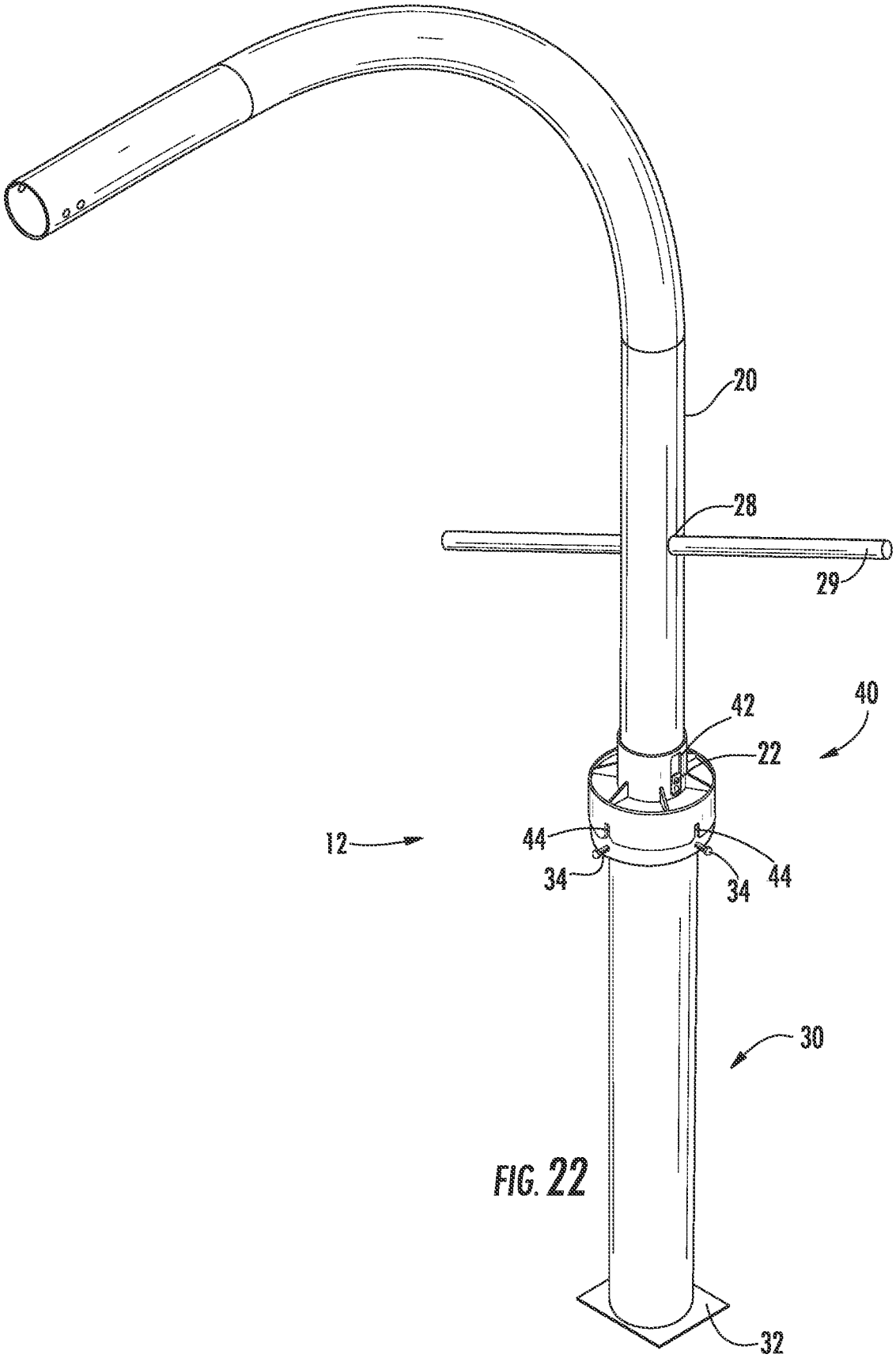
Figure 23:
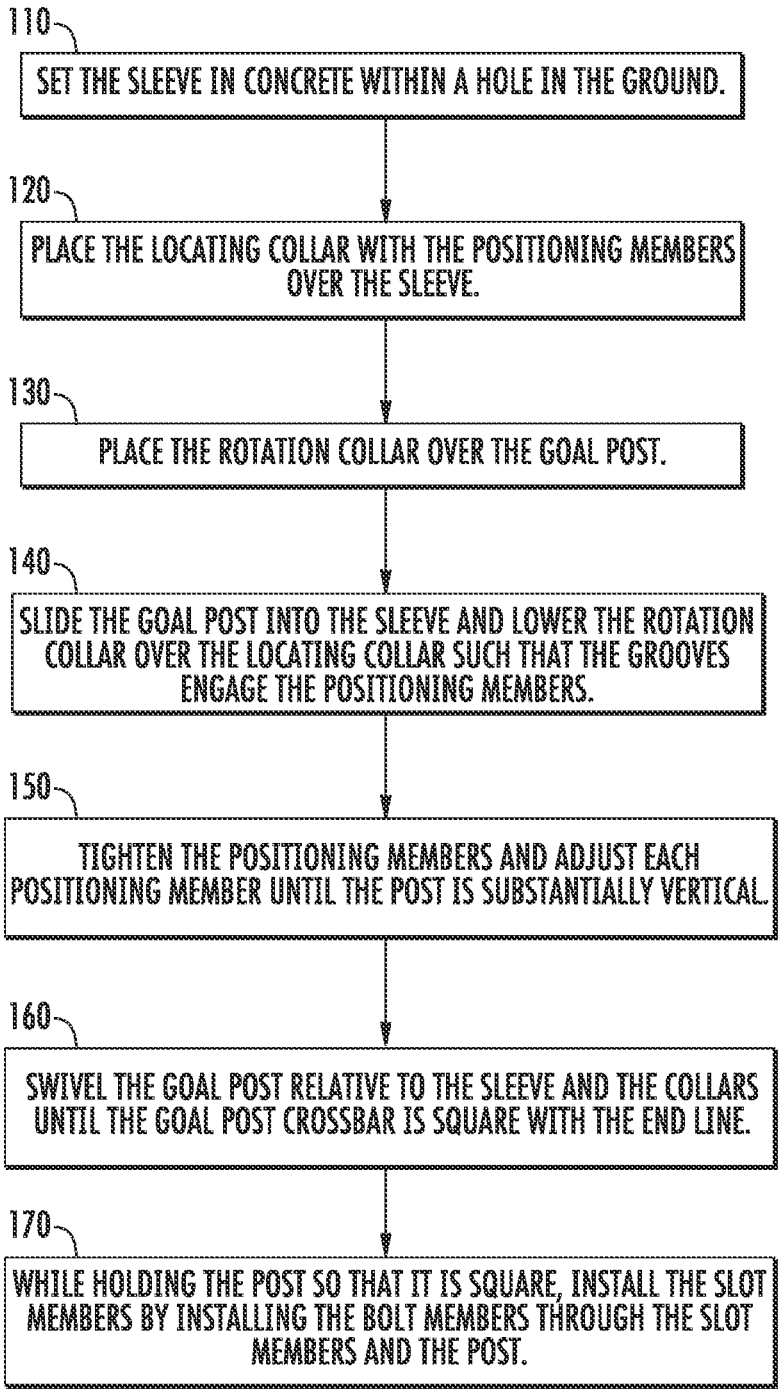

Having thus described embodiments of the invention in general terms, reference will now be made to the accompanying drawings, which are not necessarily drawn to scale, and wherein:

FIGS. 1A and 1B illustrate how, in accordance with an embodiment of the present invention, a football goalpost may be rotated about a substantially vertical axis to move the crossbar to a location where it will not significantly interfere with a soccer goal and field;

FIG. 2 illustrates a front perspective view of a football goalpost rotation apparatus having a rotation collar in a secured position in accordance with an embodiment of the present invention;

FIG. 3 illustrates a front perspective view of a football goalpost rotation apparatus having a rotation collar in a rotating position in accordance with an embodiment of the present invention;

FIG. 4 illustrates a side view of the football goalpost rotation apparatus of FIG. 2 in accordance with an embodiment of the present invention;

FIG. 5 illustrates a side view of the football goalpost rotation apparatus of FIG. 3 in accordance with an embodiment of the present invention;

FIG. 6 illustrates a side view of the football goalpost rotation apparatus of FIG. 3 and further shows positioning members carried by a locating collar, in accordance with an embodiment of the present invention;

FIG. 7 illustrates a side view of the football goalpost rotation apparatus of FIG. 3 from a different angle relative to the view in FIG. 6 and depicts how the collar may be used to make the goal vertical in accordance with an embodiment of the present invention;

FIG. 8 illustrates a side view of the football goalpost rotation apparatus of FIG. 3 and further shows the rotation collar and goalpost in an earlier stage of rotation, in accordance with an embodiment of the present invention;

FIG. 9 illustrates a side view of the football goalpost rotation apparatus of FIG. 3 and further shows the rotation collar and goal post in a later stage of rotation, in accordance with an embodiment of the present invention;

FIG. 10 illustrates a front perspective view of the football goalpost rotation apparatus having a rotation collar in a rotating position, and further shows the goal post in an approximately final stage of a 180-degree rotation from the position as shown in FIG. 2, in accordance with an embodiment of the present invention;

FIG. 11 illustrates a front perspective view of the goal post and rotation collar shown apart from the sleeve, in accordance with an embodiment of the present invention;

FIG. 12 illustrates a perspective view of the rotation collar, in accordance with an embodiment of the present invention;

FIG. 13 illustrates a perspective view of the slot members and accompanying bolt members, in accordance with an embodiment of the present invention;

FIG. 14 illustrates a perspective view of the sleeve in accordance with an embodiment of the present invention;

FIG. 15 illustrates a perspective view of the locating collar having positioning members and a positioning ring in accordance with an embodiment of the present invention;

FIG. 16 illustrates a perspective view of a sleeve having a locating collar and base in accordance with an embodiment of the present invention;

FIG. 17 illustrates a top view of the sleeve, locating collar, and positioning members, in accordance with an embodiment of the present invention;

FIG. 18 illustrates a top view of the sleeve of FIG. 17, but shown with the locating collar removed for clarity, in accordance with an embodiment of the present invention;

FIG. 19 illustrates a perspective view of the football goalpost rotation apparatus having a ball joint type configuration at the end of the goal post in the bottom of the sleeve in accordance with an embodiment of the present invention;

FIGS. 20 and 21 illustrates a perspective view of the goal post and a sleeve bearing ring in accordance with an embodiment of the present invention;

FIG. 22 illustrates a front perspective view of the football goalpost rotation apparatus where the goal post has a handle in accordance with an embodiment of the present invention; and FIG. 23 illustrates a method of installing the football goalpost rotation apparatus in accordance with an embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

As used herein and in the claims, the term "ground" refers to the surface of the earth, but also refers other natural or manmade surfaces including, for example, manmade floors in a building. For example, where the present application describes a post or sleeve as being anchored in the ground, the post or sleeve may be anchored in the dirt of a field, concrete, a floor in a building, or other material or surface suitable for anchoring the post or sleeve.

FIG. 1 illustrates how, in accordance with an embodiment of the present invention, a football goalpost 10 may be rotated about a substantially vertical axis to move the crossbar 18 to a location where it will not significantly interfere with a soccer goal 5 or field 4. More particularly, FIG. 1(*a*) illustrates how, as described above, a football field may be converted to a soccer field by positioning a soccer goal 5 in front of the football goalpost 10. In the illustrated embodiment, the football goalpost 10 has a gooseneck configuration that allows the goal post 20 to be anchored into the ground some distance behind the end line 3 of field 4. Besides being a safer football goalpost design, the gooseneck-type football goalpost 10 may also provide sufficient space for a soccer goal 5 to be positioned beneath the football goalpost's crossbar 18 so that the soccer field can share the same end line 3 as the football field. However, as described above, the crossbar 18 and the uprights 19 of the football goalpost 10 may interfere with the soccer game.

Embodiments of the present invention solve this problem and/or other problems by providing a system that allows the football goalpost 10 to be rotated about a substantially vertical axis so that the football goalpost 10 may be rotated from a position such as that illustrated in FIG. 1(*a*) to a position such as that illustrated in FIG. 1(*b*). As illustrated in FIG. 1(*b*), the football goalpost 10 has been rotated approximately 180 degrees about a substantially vertical axis running through the base of the gooseneck-type post 20. Positioned as such, the crossbar 18 and the uprights 19 are located well behind the end line 3 where they will not significantly interfere with the soccer goal 5 and field 4. As described in detail below, embodiments of the present invention provide a football goal post rotation apparatus that allows a user to easily rotate the football goalpost 10 about a substantially vertical axis. Embodiments of the football goal post rotation apparatus may further allow a user to make adjustments in the vertical and rotational alignment of the football goalpost 10 after installation.

FIGS. 2 and 3 illustrate front perspective views of a football goal post rotation apparatus 12, in accordance with and embodiment of the present invention. Apparatus 12 includes a substantially cylindrical gooseneck-type goal post 20 received within a substantially cylindrical tubular sleeve 30. The sleeve 30 is preferably securely anchored into the ground (not shown). For example, the sleeve 30 may be anchored into the ground by encasing the sleeve 30 in concrete (not shown) within a hole in the ground. As illustrated in FIG. 2, the sleeve 30 is illustrated as being slightly out-of-plumb (i.e., not perfectly vertical) to simulate how a real installation may look. Although the sleeve 30 is preferably installed vertically, embodiments of the present invention may allow some misalignment in the sleeve installation and may allow a user to adjust the verticality of the goal post 20 after installation of the sleeve 30. The mechanisms by which embodiments of the rotation apparatus 12 may allow adjustments to be made to the vertical alignment of the goal post 20 after the sleeve 30 is anchored into the ground are described in greater detail below. Although the figures herein generally depict a goal post 20 having a gooseneck-type post, other embodiments of the present invention may employ a variety of known forms for goal posts.

In the illustrated embodiment, the sleeve 30 includes a sleeve base 32, a locating collar 36 (illustrated in FIG. 3), and four positioning members 34 (two are not visible in FIGS. 2 and 3). The four positioning members 34 extend from the locating collar 36 and are spaced equidistant from each other around the circumference of the locating collar 36. In the illustrated embodiment, the positioning members 34 are threaded bolts carried by threaded apertures in the locating collar 36 to facilitate securing the locating collar 36 to the sleeve 30 and, as described in greater detail below, for positioning the goal post 20 vertically plumb within sleeve 30. Although four positioning members are illustrated in the figures described herein, in other embodiments of the invention more or less positioning members may be used as will be apparent to one of ordinary skill in the art in view of this disclosure.

The apparatus 12 further includes two slot members 22 (one is not visible in FIGS. 2 and 3) extending from the goal post 20. In the illustrated embodiment, each slot member 22 is essentially a flat or curved plate connected to the goal post 20 on opposite sides of the post 20. Each slot member 22 is connected to the goal post 20 by, for example, two bolt members 24 (illustrated in more detail in FIGS. 4 and 13). In other embodiments of the invention, however, more or less than two slot members 22 may be used and the slot members 22 may take other forms and may be connected to the goal post 20 by other techniques, as will be apparent to a person of ordinary skill in the art in view of this disclosure.

As further illustrated in FIGS. 2 and 3, apparatus 12 also includes a rotation collar 40 having two oppositely disposed slots 42 (one is not visible in FIGS. 2 and 3) and four grooves 44 (two are not visible in FIGS. 2 and 3). As with the number of slot members 22 and positioning members 34, in other embodiments of the invention the number of slots 42 and grooves 44 may be more or less than the numbers illustrated herein. In some embodiments, the number of slots 42 may be greater than or equal to the number of slot members 22 and the number of grooves 44 may be greater than or equal to the number of positioning members 24.

Returning to FIGS. 2 and 3, the rotation collar 40 is comprised of a (1) base portion 45 comprising a first cylindrical portion 41 and a planar member 46 (as shown in FIG. 12) and (2) a second cylindrical portion 43. The first cylindrical portion 41 has a generally tubular configuration and an inside diameter that is slightly greater than the outside diameter of the post 20. In this way, the post 20 is permitted to pass through the rotation collar 40 and the rotation collar 40 is permitted to slide freely over the post 20. The inside diameter of the first cylindrical portion 41, however, is close enough to the outside of diameter of the post 20 that it does not permit much if any side-to-side movement of the post 20 within the first cylindrical portion 41. The first cylindrical portion 41 includes the two slots 42, which comprise oppositely disposed cutouts in the walls of the cylindrical portion 41.

The second cylindrical portion 43 has a greater diameter than the first cylindrical portion 41 and is coupled to or integrally formed with the lower end of the first cylindrical portion 41 in such a manner that the circular cross sections of the first cylindrical portion 41 and the second cylindrical portion 43 are concentric to one another. In this way, the second cylindrical portion 43 is configured to share the same longitudinal axis with the post 20 when the rotation collar 40 is positioned around the post 20. In a preferred embodiment, the inside diameter of the second cylindrical portion 43 is only slightly greater than the outside diameter of the locating collar 36. In this way, the second cylindrical portion 43 of the rotation collar 40 can freely slide over the locating collar 36, but the rotation collar 40 is not permitted to move much in any side-to-side direction relative to the locating collar 36 when the locating collar 36 is within the second cylindrical portion 43. The second cylindrical portion 43 further includes the four grooves 44 which comprise four cutouts in the walls and which extend from an opening in the lower end of the second cylindrical portion 43. As illustrated, the grooves 44 may flare outwards proximate the lower end of the second cylindrical portion 43 to allow the grooves to more easily receive the positioning members 34 and to channel the positioning members 34 into the upper portion of the grooves 44 which may be only just slightly wider than the diameter of the positioning members 34. In the illustrated embodiment, the four grooves 44 are spaced equidistant from each other around the circumference of the second cylindrical member 43 so that each of the four grooves 44 can simultaneously receive a different one of the four positioning members 34 when the second cylindrical portion 43 is disposed over the locating collar 36.

As illustrated in FIGS. 2 and 3, the slots 42 are adapted to cooperate with the slot members 22 and the grooves 44 are adapted to cooperate with positioning members 34 to enable the rotation collar 40 to move between a secured position (shown in FIGS. 2 and 4) and a rotating position (shown in FIGS. 3 and 5). As illustrated in FIGS. 2 and 4, in the illustrated embodiment the rotation collar 40 is in the secured position when the second cylindrical portion 43 is disposed over the locating collar 36 such that the grooves 44 receive the positioning members 34 therein. As also illustrated, when the rotation collar 40 is in the secured position, the upper outside edge of the slot members 22 are approximately in contact with the upper inside edge of the slots 42.

It should be appreciated that slot members 22 and the slots 42 are shaped and configured such that they cooperate to prevent the goal post 20 from rotating with respect to rotation collar 40, in both the secured and rotating positions. The positioning members 34 and the grooves 44 are shaped and configured so that, when the rotation collar 40 is in the secured position, the positioning members 34 and the grooves 44 cooperate to prevent the rotation collar 40 (and therefore goal post 20) from rotating with respect to locating collar 36 (and therefore the sleeve 30).

As illustrated in FIGS. 3 and 5, in the illustrated embodiment the rotation collar 40 is in the rotating position when the rotation collar 40 is moved upwards along the post 20 to a position where the grooves 44 are approximately disengaged from positioning members 34. In such a position the lower outside edge of the slot members 22 may be approximately in contact with the lower inside edge of the slots 42, as shown in FIGS. 3 and 5. Once the rotation collar 40 is in the rotating position, the goal post 20 (along with the rotation collar 40) is free to rotate within the sleeve 30. In some embodiments of the present invention, the goal post rotation apparatus 12 further includes a holding member (not shown) for releasably holding the rotation collar 40 in the rotating position illustrated in FIG. 3. Such a holding member may make it easier for a single person to first move the rotation collar 40 to the rotating position and then rotate goal post 20 to the desired position.

Although the figures herein generally depict the rotation collar 40 as being separate and distinct from goal post 20 and capable of movement relative thereto, in other embodiments of the present invention the goal post 20 and rotation collar 40 may be fixed relative to one another (and, in some instance, even integrally formed with one another). In such an embodiment, instead of sliding the rotation collar 40 upwards relative to the post to disengage the positioning members from the grooves 40, the entire goal post 20 may be lifted to disengage the positioning members and to rotate the post within the sleeve.

Returning to the figures, for purposes of illustration, FIGS. 6-8 depict the locating collar 36 as partially transparent in order to illustrate how the positioning members 34 and the locating collar 36 may interact with each other and with the sleeve 30 in accordance with embodiments of the present invention. As illustrated in these figures, the bolt-type positioning members 34 are screwed through the wall of the locating collar 36 until they contact the outside wall of the sleeve 30. The cross-hashed portion of the figures illustrate a cross-section of the locating collar 36 and illustrate how, in at least some embodiments, the inside diameter of the locating collar 36 is significantly greater than the outside diameter of the sleeve 30. Furthermore, bolt-type positioning members 34 are significantly longer than the thickness of the wall of the locating collar 36 and the inside diameter of the sleeve 30 is significantly greater than the outside diameter of the post 20. This configuration permits the locating collar 36 to be secured by the positioning members around the sleeve 30 such that the locating collar 36 is not concentric with the sleeve 30. In this way, the user is able to adjust the verticality of the post 20 after the sleeve 30 has been permanently installed within the ground.

For example, FIG. 6 illustrates the sleeve 30 slightly out-of-plumb such that it is leaning towards the right side of FIG. 6. As illustrated, the positioning members 34 may be screwed into the locating collar 36 to different degrees such that the locating collar 36 is secured around the sleeve 30, but shifted to the left side of FIG. 6. As described in greater detail below, the bottom end of the post 20 within the sleeve 30 is permitted to act as a pivot so that moving the locating collar 36 to one side or the other relative to the sleeve 30 allows the user to change the verticality of the post 20.

In general FIGS. 2-10 sequentially illustrate how to rotate the goal post 20 approximately 180 degrees in accordance with an objective of embodiments of the present invention. As illustrated by FIGS. 2-5, to prepare the goal post 20 for rotation, rotation collar 40 is vertically moved relative to the goal post 20 in order to approximately disengage the grooves 44 from positioning members 34. This action also causes the slots 42 to simultaneously move relative to the slot members 22. In a preferred embodiment, the vertical movement of the rotation collar 40 relative to the goal post 20 is limited by how far the slot members 22 may travel within the slots 42. In this regard, the slots 42 are at least as long as the grooves 44 (and may be longer) to permit the grooves 44 to fully disengage the positioning members 34. As such, the movement of the rotation collar 40 from the secured position (FIGS. 2 and 4) to the rotating position (FIGS. 3 and 5) enables the goal post 20 and the rotation collar 40 to freely rotate relative to sleeve 30.

FIGS. 8-10 illustrate rotating the goal post 20 and the rotation collar 40 through 180 degrees of movement. Specifically, FIG. 8 illustrates an earlier stage in the 180 degree rotation where grooves 44 are completely disengaged from and no longer aligned with positioning members 34. FIG. 8 also indicates that slots 42 are approximately contacting the lower edges of slot members 22 at this stage in the rotation. FIG. 9 illustrates a later stage in the 180 degree rotation where positioning members 34 are approximately equidistant between corresponding grooves 44. Again, slots 42 are approximately contacting the lower edges of slot members 22 at this stage. FIG. 10 shows an approximately final stage in the 180 degree rotation where goal post 20 is approximately 180 degrees rotated from its original position in FIG. 3. As illustrated, positioning members 34 are approximately aligned with grooves 44, and slots 42 are approximately contacting the lower edges of slot members 22. In general, FIG. 10 illustrates the approximate stage where rotation collar 40 is capable of being vertically moved back into a secured position to prevent the goal post 40 from being further rotated.

FIGS. 11-15 illustrate portions of the football goal post rotation apparatus 12 in greater detail, in accordance with an embodiment of the present invention. FIG. 11 illustrates the goal post 20 and the rotation collar 40 without showing the sleeve 30. FIG. 11 also illustrates that, in one embodiment, the goal post 20 includes a semi-spherical member 26 at the lower end of the goal post 20 for cooperating with a sleeve bearing ring 37 (shown in FIGS. 19-21) to form a ball and socket type joint or some other pivot-type joint, as will be explained in greater detail below.

FIGS. 12 and 13 illustrate the rotation collar 40 and the slot members 22 (with accompanying bolt members 24), respectively, shown by themselves. FIG. 14 illustrates the sleeve 30 shown by itself and having the sleeve base 32. FIG. 15 illustrates the locating collar 36 with the positioning members 34 threaded through apertures therein. FIG. 15 also shows how the locating collar 36 may further comprise a positioning ring 35 coupled to the cylindrical portion of the locating collar 36. As described above, the inside diameter of the cylindrical portion of the locating collar 36 may be significantly larger than the outside diameters of the sleeve 30 and the post 20 so that the locating collar can be used to adjust the verticality of the post 20. As illustrated, the positioning ring 35 may be a circular plate welded to or otherwise coupled to the cylindrical portion of the locating collar 36. The positioning ring 35 may have a circular cutout concentric with the cylindrical portion of the locating collar 36 and having a diameter only just slightly larger than the outside diameter of the post 20. Such a positioning ring 35 may permit the locating collar to adjust verticality of the post 20 without the rotation collar 40 being positioned over the locating collar 36.

Referring now to FIG. 16-18 further illustrate how the sleeve 30 and the locating collar 36 may interact with each other to adjust the verticality of the post 20 relative to the sleeve 30. FIGS. 16 and 17 illustrate a perspective view and a top view, respectively, of the sleeve 30 with the locating collar 35 secured thereto. FIG. 18 illustrates a top view of the sleeve where the locating collar 36 has been removed in order to illustrate how, for example, the installation of the sleeve 30 could result in a sleeve 30 that is not perfectly vertical and instead leans in one direction or another. However, as illustrated in FIG. 17, the locating collar 36 can move relative to the top of the sleeve 30 in order to substantially vertically align the locating collar 36 with the bottom of the sleeve 30. As illustrated, this can be accomplished by adjusting the positioning members 34 by screwing them through the walls of the locating collar 36 at different amounts until they contact the sleeve 30 disposed therein.

FIGS. 19-21 illustrate how the bottom of the post 20 and the sleeve 30 may interact so that the post 20 may pivot from the bottom of the sleeve during adjustments to the vertical alignment of the post, but also rotate relative to the sleeve, in accordance with an embodiment of the present invention. For purposes of illustration, the cylindrical walls of the sleeve 30 and the post 20 are depicted as partially transparent and the cylindrical walls of the sleeve 30 and the base 32 of the sleeve 30 have been removed from FIGS. 20 and 21. As described above, the bottom end of the post 20 may include a semi-spherical member 26. According to the illustrated embodiment, when the goal post 20 is inserted into sleeve 30, the semi-spherical member 26 cooperates with a sleeve bearing ring 37 set within the bottom of the sleeve 30 to reduce the frictional forces associated with rotating goal post 20 and to allow the goal post to pivot from the bottom during adjustments to the vertical alignment of the post 20.

FIG. 22 illustrates how the goal post 20 may further include a handle for aiding in the rotation of the post 20 relative to the sleeve 30. In the illustrated embodiment, the post comprises two opposing handle apertures 28 adapted to removably receive a bar-like handle 29 for facilitating rotation of goal post 20. Since the handle 29 is removable, the handle 29 can be removed when not needed to rotate the goal post 20 so that the handle 29 does not pose a safety hazard to athletes during the game. In other embodiments, the handle may take other forms. For example, in one embodiment, the post comprises one or more periscope-type handles that fold against the post when not in use. When in the folded configuration, such handles may be covered by a standard football goalpost pad that wraps around the base of the post and the handles to protect the athletes from the post and the handles.

FIG. 22 illustrates a method of installing the goal post in accordance with an embodiment of the present invention. This method is an illustration of one exemplary embodiment of the present invention; other embodiments of the invention may other methods of installation or may involve performing the steps in a different order. As illustrated by Block 110, the sleeve 30 in set in concrete within a hole in the ground. As illustrated by Block 120, the locating collar 36 with the positioning members 34 is positioned over the top of the sleeve 30. As illustrated by Block 130, the rotation collar 40 is slid over the goal post 20. As illustrated by Block 140, the goal post 20 is slid into the sleeve 30 and the rotation collar 40 is lowered over the locating collar 36 such that the grooves 44 engage the positioning members 34. As illustrated by Block 150, the positioning members 34 are tightened and adjusted until the post 20 is substantially vertical. Once the post 20 is made vertical in this manner, the post 20 should not have to be readjusted for verticality unless the positioning members 34 become loosened. As illustrated by Block 160, the goal post 20 is swiveled relative to the sleeve 30 and the collars 36 and 40 until the goal post crossbar 18 is square with the end line 3. As illustrated by Block 170, while holding the post 20 so that it remains square, the slot members 22 are field installed by screwing the bolt members 24 through the slot members 22 and the post 20. It should be appreciated that, once the goal post 20 is made square in this manner, the goal post 20 should consistently be square when the rotation collar 20 is in a secured position and goal post 20 is facing forward unless the positioning members 34 become loosened.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A goalpost rotation apparatus for permitting a football goalpost to be rotated relative to the ground, the goalpost rotation apparatus comprising:

a first collar connected to the goalpost, the first collar comprising a base portion and a collar portion wherein the base portion comprises a planar member and is positioned between the collar portion and the goalpost; and an anchoring mechanism fixedly anchored to the ground, the anchoring mechanism comprising a second collar and a base plate, wherein the second collar defines an outside perimeter, wherein the base plate is positioned between the ground and the second collar and wherein at least a portion of the first and second collars are overlapping concentrically, one inside the other, and wherein the base portion of the first collar extends beyond the outside perimeter of the second collar, and wherein the first and second collars are rotatably connected to thereby connect the goalpost to the anchoring mechanism so that the goalpost can rotate relative to the anchoring mechanism.

2. The goalpost rotation apparatus of claim 1, further at least one positioning member for positioning the first collar relative to the second collar.

* * * * *